United States Patent [19]

Okamoto et al.

[11] Patent Number: 4,502,777

[45] Date of Patent: Mar. 5, 1985

[54] TRANSFER TYPE ELECTROPHOTOGRAPHIC COPYING APPARATUS WITH SUBSTANTIALLY CONSTANT POTENTIAL CONTROL OF PHOTOSENSITIVE MEMBER SURFACE

[75] Inventors: Hiroshi Okamoto, Shinshiro; Kouzi Matsushita, Toyokawa, both of Japan

[73] Assignee: Minolta Camera Kabushiki Kaisha, Osaka, Japan

[21] Appl. No.: 368,448

[22] Filed: Apr. 14, 1982

[30] Foreign Application Priority Data

May 2, 1981 [JP] Japan ..... 56-67512
Mar. 4, 1982 [JP] Japan ..... 57-34768

[51] Int. Cl.[3] ..... G03G 15/00

[52] U.S. Cl. ..... 355/14 R; 355/14 CH; 355/14 E

[58] Field of Search ..... 355/14 R, 14 CH, 14 E, 355/67, 69, 83, 35, 3 CH, 3 R, 14 C

[56] References Cited

U.S. PATENT DOCUMENTS

| | | | |
|---|---|---|---|
| 3,788,739 | 1/1974 | Coriale | 355/17 |
| 3,981,268 | 9/1976 | Tsakamoto et al. | 118/667 |
| 4,019,102 | 4/1977 | Wallot | 361/225 |
| 4,136,945 | 1/1979 | Stephens | 355/69 X |
| 4,215,930 | 8/1980 | Miyakawa et al. | 355/14 E X |
| 4,284,344 | 8/1981 | Okamoto et al. | 355/14 |
| 4,326,796 | 4/1982 | Champion et al. | 355/14 CH |
| 4,355,885 | 10/1982 | Nagashima | 355/3 CH |

FOREIGN PATENT DOCUMENTS

| | | | |
|---|---|---|---|
| 0009631 | 1/1979 | Japan . | |
| 0022305 | 8/1979 | Japan . | |
| 60968 | 5/1980 | Japan | 355/14 CH |
| 90966 | 7/1980 | Japan | 355/14 E |
| 155961 | 12/1981 | Japan | 355/14 E |
| 2039101 | 7/1980 | United Kingdom | 355/14 CH |

*Primary Examiner*—A. T. Grimley
*Assistant Examiner*—J. Pendegrass
*Attorney, Agent, or Firm*—Wenderoth, Lind & Ponack

[57] ABSTRACT

An electrophotographic copying apparatus which includes a photosensitive member or photoreceptor which is repeatedly utilized for formation of electrostatic latent images on it, a device for forming an electrostatic latent image on a photoreceptor surface, a device for detecting conditions affecting the operating characteristics of the photoreceptor, a device for determining the state of operation of the image forming device according to the conditions detected by the detecting device, the conditions being in a predetermined relationship which is specifically represented by a predetermined reference equation, a device for correcting the state of operation of the image forming device so as to render a potential of the latent image formed on the photoreceptor surface substantially constant, and a device for successively revising the reference equation based on the conditions detected by the detecting device and the state of operation which has been corrected by the correcting device.

4 Claims, 24 Drawing Figures

TRANSFER TYPE ELECTROPHOTOGRAPHIC COPYING APPARATUS WITH SUBSTANTIALLY CONSTANT POTENTIAL CONTROL OF PHOTOSENSITIVE MEMBER SURFACE

BACKGROUND OF THE INVENTION

The present invention generally relates to copying apparatus and more particularly, to an electrophotographic copying apparatus provided with a control mechanism for maintaining the potential of an electrostatic latent image which is formed on the surface of a photosensitive member or photoreceptor, constant at all times.

Generally, in a transfer type electrophotographic copying apparatus, for the stabilization of the quality of copied images, it is necessary to maintain the charge potential of the photoreceptor at a predetermined value, i.e.—the surface potential at the image area of an electrostatic latent image and/or the potential at the background thereof must be maintained at a predetermined value, irrespective of the surrounding conditions, operating conditions, etc. of the photoreceptor. It is to be noted that the above surrounding conditions are those affecting the characteristics of the photoreceptor, and will be referred to as such hereinbelow.

In the first place, the present inventors have carried out various experiments with respect to the charge potentials of photoreceptors for maintaining the surface potential at the image area of the electrostatic latent image at a predetermined value, and have ensured that there exists an approximately constant proportional relationship between the surface potential (charge potential) of the photoreceptor and the current flowing through a corona charger, and have thus developed a method therefor as will be explained hereinbelow with reference to FIG. 1. For the experiments referred to above, photoreceptors of Se.Te alloy were employed.

In a graph of FIG. 1, the abscissa represents currents flowing through the corona charger, while the ordinate denotes the surface potential of a photoreceptor drum, with a final target charge potential being represented by ($VRE_1$). A straight line ($A_1$) represents the characteristics of the photoreceptor under standard conditions, while another straight line ($A_1'$) represents the characteristics thereof during actual use, and the inclination of the lines ($A_1$) and ($A_1'$) may vary in various ways depending on different surrounding conditions.

Accordingly, it is suitable for a general practice to first cause a current with a value ($I_0$) to flow through the corona charger at an initial stage of charging, while, in correspondence with a detection value (Vm) for the surface potential, a correction current represented by ($I_1$) [$I_1 = I_0 \cdot VRE_1/Vm$] is caused to flow therethrough, and thereafter, similar corrections are repeated until the detection value of the surface potential reaches the final target charge potential ($VRE_1$) for subsequently effecting copying process.

However, in the practice as described above, there has been such disadvantages that, since it is required to wastefully move the photoreceptor drum by a distance (l) (FIG. 6) from a charging position to a detecting position, i.e. by a distance equivalent to "the number of corrections x (l)" in total at each time of correction of the current value with respect to the corona charger, without regard to the substantial copying operation, copying speed is undesirably reduced as the number of corrections is increased.

Incidentally, as shown in a graph of FIG. 2, the characteristics of the Se.Te alloy photoreceptor (i.e. the inclination of the line ($A_1$)) vary in different curves, largely depending on temperature variations of the photoreceptor drum and according to whether the copying apparatus is at an initial stage of its use (solid line curve ($B_1$)) or it has been used for a long period of time (dotted line curve ($B_1'$)).

In connection with the above, in the experiments carried out by the present inventors, it has been ensured that the variations as described above may be approximately represented, at temperatures higher than 25° C., by a quadratic equation $$K_1TPC^2 + K_2TPC + K_3$$

where TPC is the surface temperature of the photoreceptor, and, at temperatures lower than 25° C., by a simple equation $$K_4TPC + K_5$$

On the other hand, apart from the surface potential at the image area of the electrostatic latent image, the present inventors have also conducted various experiments with respect to potentials of a reference latent image formed on the surface of the photoreceptor and having a potential equal to the background area of the electrostatic latent image, in an attempt to maintain the potential in such background area at a predetermined constant value.

As a result, through utilization of the fact that there is an approximately constant proportional relationship between the potential of the reference latent image and a voltage for an exposure lamp, the present inventors have developed a method therefor as shown in a graph of FIG. 3. In the above case also, the photoreceptors employed in the experiments were of Se.Te alloy.

In the graph of FIG. 3, the abscissa represents exposure lamp voltages (LV), while the ordinate denotes potentials (IV) on the surface of the photoreceptor drum at its portion where the reference latent image is formed, with the final target potential being represented by ($VRE_2$). A curve ($V_2$) shows characteristics of the photoreceptor under standard conditions, while another curve ($A_2'$) represents characteristics of the photoreceptor during actual use, which may differ depending on various using conditions and surrounding conditions and the like.

The final target potential ($VRE_2$) referred to above is set at such a potential as will not produce fogging in the copied imges. In the actual copying, since originals in various contrast may be employed, it is necessary to arrange that copied images of various originals are preferably free from formation of fogging. In the experiments as carried out by the present inventors, on the assumption that the reflecting density at the background area of the original image is less than 0.25, a reference latent image forming pattern with the reflection density of 0.25 was employed, while the final target potential ($VRE_2$) was set at 300 V, with a developing bias fixed at 300 V. It is to be noted that, under the above conditions, the portions of the electrostatic latent image corresponding to the portions of the original image having reflection density less than 0.25, i.e. the background portions of the electrostatic latent image, are not developed.

Accordingly, under certain conditions represented by the curve ($A_2'$), a voltage at a value ($LV_0$) is first applied to the exposure lamp at the initial stage of the reference latent image formation, and in correspondence with the detection value (IVm) for the surface potential, a correction voltage $LV_1$ represented by $$LV_1 = LV_0 \cdot \frac{IVX - VRE_2}{IVX - IVm}$$

is applied thereto, and thereafter, similar corrections are repeated until the detection value for the surface potential reaches the final target potential ($VRE_2$) for subsequently effecting the copying process.

It is to be noted that in the above equation, (IVX) is a value set as a constant for convenience, of a surface potential at a point where the ordinate intersects an extension of a tangent line on the final target potential ($VRE_2$) in the photoreceptor surface potential characteristics under the standard conditions with respect to the exposure lamp voltage (LV) as shown in FIG. 3.

In the above method, however, it is also necessary to wastefully move the photoreceptor drum by the distance (l') (FIG. 13) from an exposing position to a detecting position, i.e. by a distance equivalent to "the number of corrections x (l')" in total at each time of correction of the voltage value with respect to the exposure lamp and irrespective of the substantial copying operation, thus resulting in such disadvantages that the copying speed is undesirably reduced as the number of corrections is increased.

As described earlier, the characteristics of the Se.Te alloy photoreceptor (i.e. the inclination of the curve $A_2$ and more accurately, the value represented by $(IVX-VRE_2)/LV$) vary as shown in FIG. 4 in different curves, largely depend on temperature variations of the photoreceptor drum and according to whether the copying apparatus is at an initial stage of its use (curve $B_2$) or it has been used for a long period of time (curve $B_2'$).

In connection with the above, it has also been confirmed in the experiments conducted by the present inventors that the variations as referred to above may be approximately represented, at temperature higher than 25° C., by the quadratic equation $$K_1'TPC^2 + K_2'TPC + K_3'$$

where TPC is the surface temperature of the photoreceptor, and, at temperatures lower than 25° C., by the simple equation $$K_4'TPC + K_5'$$

Meanwhile, it has also been ensured that with respect to the number of repetitions of copying operation within a short period of time also, the characteristics vary in different inclinations between an initial stage of repetition (curve C) and stages after repetition for many times (curve C') as shown in FIG. 5, and that the variations may be approximately represented, at repetitions less than ten times, by a simple equation $$K_6' \cdot \log N + K_7'$$

and at repetitions more than ten times, by a simple equation $$K_8' \cdot \log N + K_9'$$

SUMMARY OF THE INVENTION

Accordingly, an essential object of the present invention is to provide an improved transfer type electrophotographic copying apparatus in which, with particular attention directed to the results of experiments described so far, there is provided a control mechanism for effecting at least one of the respective methods described earlier as developed by the present inventors, and yet, problems related to the reduction in copying speed have been improved.

Another important object of the present invention is to provide a transfer type electrophotographic copying apparatus of the above described type which is capable of quickly maintaining potential of an electrostatic latent image to be formed on the surface of a photoreceptor at a predetermined constant value, regardless of the surrounding conditions, operating conditions, etc. of the photoreceptor.

A further object of the present invention is to provide a transfer type electrophotographic copying apparatus of the above described type which is stable in functioning and able to produce satisfactory copy images at all time.

In accomplishing these and other objects according to one preferred embodiment of the present invention, there is provided a transfer type electrophotographic copying apparatus which comprises an electrographic photosensitive member or photoreceptor repeatedly utilized for the formation of electrostatic latent image thereon, a charging means for uniformly charging the surface of said photosensitive member prior to image exposure during formation of the electrostatic latent image, a condition detecting means for detecting conditions affecting characteristics of the photosensitive member, a determining means for determining state of functioning of said charging means according to the conditions detected by said detecting means at a predetermined correlation specifically represented by a reference equation, a surface potential detecting means for detecting the surface potential of said photosensitive member charged by said charging means, a correcting means for correcting the state of functioning of said charging means, based on the surface potential detected by said potential detecting means, so that the surface potential of said photosensitive member becomes a predetermined value, and a revising means for successively revising the reference equation based on the conditions detected by said condition detecting means and the state of functioning corrected by said correcting means.

By the arrangement according to the present invention as described above, an improved transfer type electrophotographic copying apparatus has been advantageously presented, with substantial elimination of the foregoing disadvantages.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts and items are designated by like reference numerals and symbols throughout several views of the accompanying drawings.

DETAILED DESCRIPTION OF THE INVENTION

In the first place, it is to be noted that the essential point of the present invention resides in that optimum image forming conditions to be determined depending on the characteristics of a photoreceptor which vary according to surrounding conditions, operating conditions, etc. of the photoreceptor, and more specifically, the current caused to flow through a corona charger or the voltage to be applied to an exposure lamp, are determined through approximation by using reference equations, with the reference equations being successively revised or corrected to follow variations in the characteristics of the photoreceptor.

Figure 6:
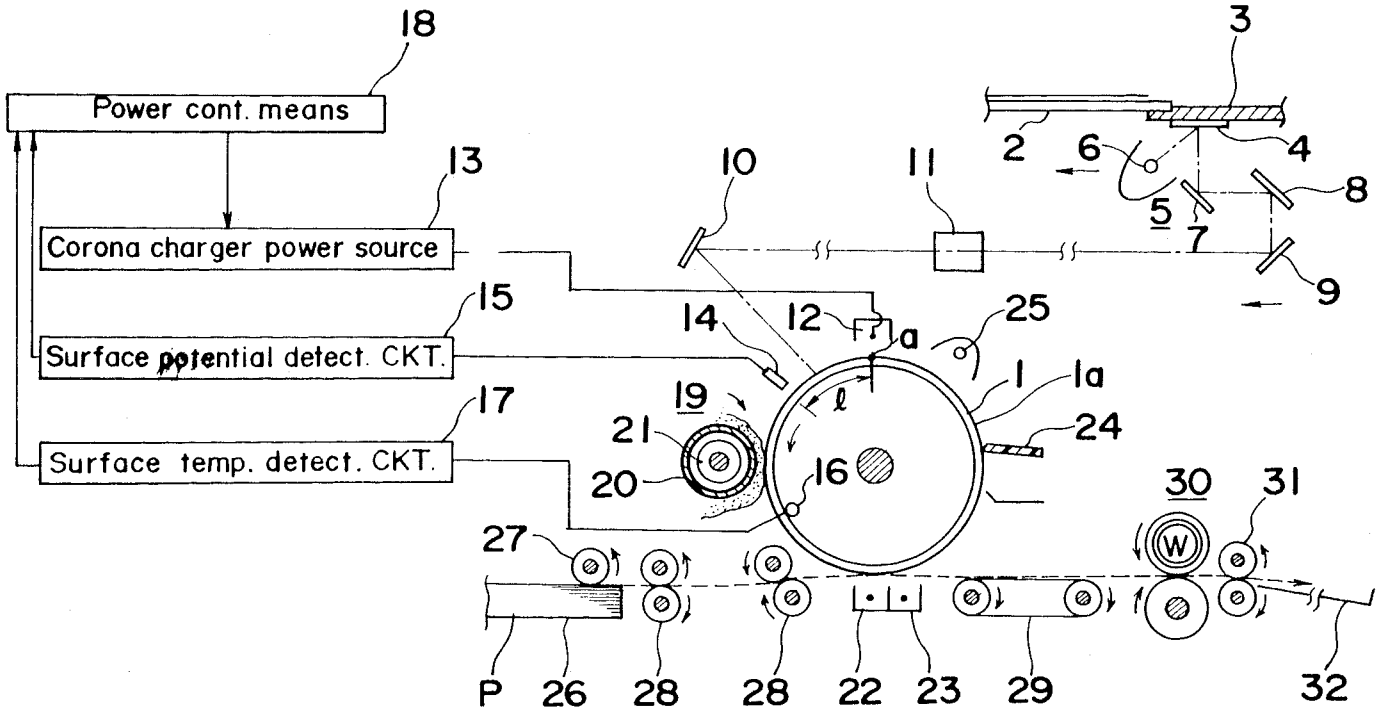
FIG. 6 is a schematic side elevational view, partly in section, of an electrophotographic copying apparatus according to one preferred embodiment of the present invention.

Referring now to the drawings, there is shown in FIG. 6, a transfer type electrophotographic copying apparatus according to one preferred embodiment of the present invention.

The copying apparatus of FIG. 6 generally includes a photosensitive or photoreceptor drum (1) having a photosensitive layer (1*a*) formed on its peripheral surface and rotatably provided at approximately a central portion of an apparatus housing (not particularly shown) for rotation in the counterclockwise direction as indicated by an arrow, around which there are sequentially disposed in a known manner, various processing device such as a corona charger (12) connected to a corona charger power source (13) for uniformly charging the photosensitive layer (1*a*), a magnetic brush type developing device (19) including a developing sleeve (20) in which a magnet roller (21) is incorporated for developing an electrostatic latent image formed on the photosensitive layer (1*a*) into a visible toner image as developing material moves over the developing sleeve (20) in the clockwise direction, a transfer charger (22) for transferring the developed toner image onto a copy material such as a copy paper sheet (P), a copy paper separation charger (23), a cleaner (24) for removing toner remaining on the photosenstive layer (1*a*), and an eraser lamp (25) for erasing charge remaining on the photosensitive layer (1*a*). Between the corona charger (12) and the developing device (19), a potential detecting element (14) is provided for detecting the surface potential of the photoreceptor layer (1*a*), with the output of the detecting element (14) being connected to a surface potential detection circuit (15). Subsequent to the developing device (19) and adjacent to the photosensitive layer (1*a*), there is provided a temperature detecting element (16). The output of the element (16) is to be applied to a surface temperature detection circuit (17). Meanwhile, current values or voltage values for the corona charger power source (13) is controlled by a power control means (18) coupled thereto, and the outputs from the surface potential detection circuit (15) and surface temperature detection circuit (17) are arranged to be applied to said power control circuit (18).

The copying apparatus of FIG. 6 further includes an original platform (2) of a transparent material such as glass or the like shown at the upper right portion in FIG. 6 and supported by an upper plate (3), with a charge potential adjusting black pattern (4) being provided on the under surface of the upper plate (3) at its side for starting scanning of an original image, and an image projection device of optical system (5) provided below the original platform (2) and including an illumination light source or exposure lamp (6), reflecting mirrors (7), (8), (9) and (10) suitably inclined to transmit the lightwise image of the original onto the photosenstive layer (1*a*) through a projection lens (11). During the image projection, the exposure lamp (6) and reflecting mirror (7) are moved at the same speed as the circumferential speed (v) of the photoreceptor drum (1), and the reflecting mirrors (8) and (9) are moved at a speed of (v/2) in the leftward direction in FIG. 6. Along a path for the copy paper below the photoreceptor drum (1), there are sequentially provided a copy paper cassette (26) accommodating a stack paper sheets (P) therein, a copy paper feeding roller (27) for feeding the copy paper sheets one by one from the top sheet of the stack, two pairs of copy paper transport rollers (28), a copy paper transport belt (29) movably supported by a pair of spaced rollers, a heat roller type fixing device (30) for fixing the toner image transferred onto the copy paper sheet to said copy paper sheet, and a pair of discharge rollers (31) for discharging the copy paper sheet onto a tray (32) after the fixing.

It is to be noted here that, as items to be detected, there may be raised temperature, humidity, absolute humidity, etc., but that, in the present embodiment, since Se.Te alloy photoreceptor, whose characteristics are largely dependent on temperatures, is employed, the surface temperature of the Se.Te alloy photoreceptor is arranged to be detected. Needless to say, it may be so arranged that several kinds of factors are detected, but owing to the fact that reference equations to be described hereinbelow become complicated with the increase of the number of items to be detected, it is generally preferable to detect only the factor having the highest dependency. For example, in the case of a CdS resin photoreceptor, detection of humidity is desirable.

Subsequently, principle for determining the reference equations will be described.

Figure 7:
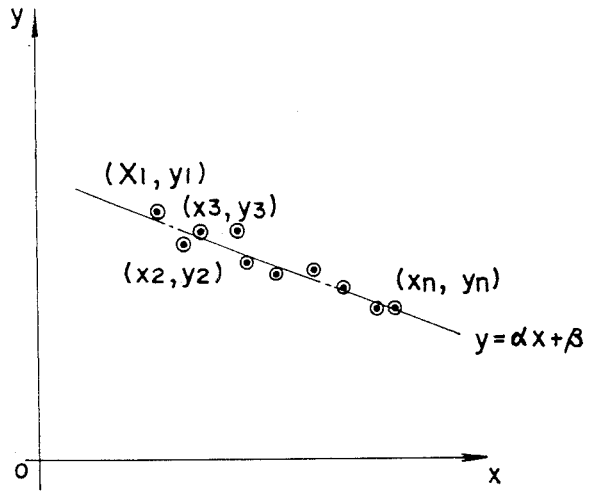
FIGS. 7 and 8 are graphs explanatory of determination of reference equations for the copying apparatus of the present invention.

As shown in FIG. 7, in the case where the correlation between x and y is to be approximately represented by an equation $$y=\alpha x+\beta \qquad (1)$$

based on the method of least squares from n sets of data for $(x_1,y_1)$, $(x_2,y_2)$ . . . , and $(x_n,y_n)$, $\alpha$ and $\beta$ must be of values which will reduce, to the minimum, a value S as represented by $$S = \sum_{t=1}^{n} [y_t - (\alpha x_t + \beta)]^2 \quad (2)$$

The conditions for rendering the above value S to the minimum are $$\begin{cases} \delta S/\delta\alpha = 0 \\ \delta S/\delta\beta = 0 \end{cases} \quad (3)$$

and $\alpha$ and $\beta$ for satisfying these conditions may be derived as a solution of simultaneous equations as follows.

$$\begin{cases} \sum_{t=1}^{n} \alpha x_t^2 + \sum_{t=1}^{n} \beta x_t = \sum_{t=1}^{n} x_t y_t \\ \sum_{t=1}^{n} \alpha x_t + \sum_{t=1}^{n} \beta = \sum_{t=1}^{n} y_t \end{cases} \quad (4)$$

In other words, $\alpha$ and $\beta$ as described above may be derived from a determinant as follows.

$$\begin{bmatrix} \alpha \\ \beta \end{bmatrix} = \begin{bmatrix} \sum_{t=1}^{n} x_t^2 & \sum_{t=1}^{n} x_t \\ \sum_{t=1}^{n} x_t & n \end{bmatrix}^{-1} \begin{bmatrix} \sum_{t=1}^{n} x_t y_t \\ \sum_{t=1}^{n} y_t \end{bmatrix} \quad (5)$$

Figure 8:
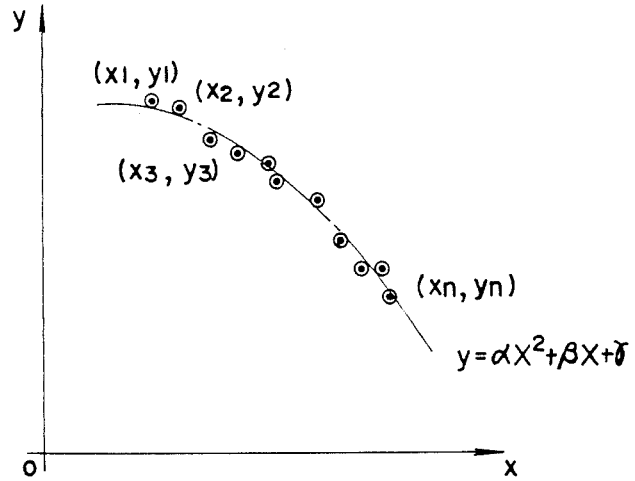

On the other hand, as shown in FIG. 8, in the case where the correlation between x and y is to be approximately represented, from n sets of data $(x_1,y_1)$, $(x_2,y_2)$ . . . , and $(x_n,y_n)$ based on the method of least squares, by an equation $$y=\alpha x^2+\beta x+\gamma \quad (1)'$$

$\alpha$, $\beta$ and $\gamma$ may be derived, on the basis of the same reason as for deriving the equation (5), by a following determinant $$\begin{bmatrix} \alpha \\ \beta \\ \gamma \end{bmatrix} = \begin{bmatrix} \sum_{t=1}^{n} x_t^4 & \sum_{t=1}^{n} x_t^3 & \sum_{t=1}^{n} x_t^2 \\ \sum_{t=1}^{n} x_t^3 & \sum_{t=1}^{n} x_t^2 & \sum_{t=1}^{n} x_t \\ \sum_{t=1}^{n} x_t^2 & \sum_{t=1}^{n} x_t & n \end{bmatrix}^{-1} \begin{bmatrix} \sum_{t=1}^{n} x_t^2 y_t \\ \sum_{t=1}^{n} x_t y_t \\ \sum_{t=1}^{n} y_t \end{bmatrix} \quad (5)'$$

Although approximation of equations higher than a cubic equation may be effected in a manner similar to the above, the simple equation and quadratic equation are to be dealt with in the present embodiment.

Subsequently, the process for determining the state of functioning of the corona charger (12) i.e. current value caused to flow through the corona charger (12) in the present embodiment will be explained with reference to the flow charts of FIGS. 9 through 12.

Figure 9:
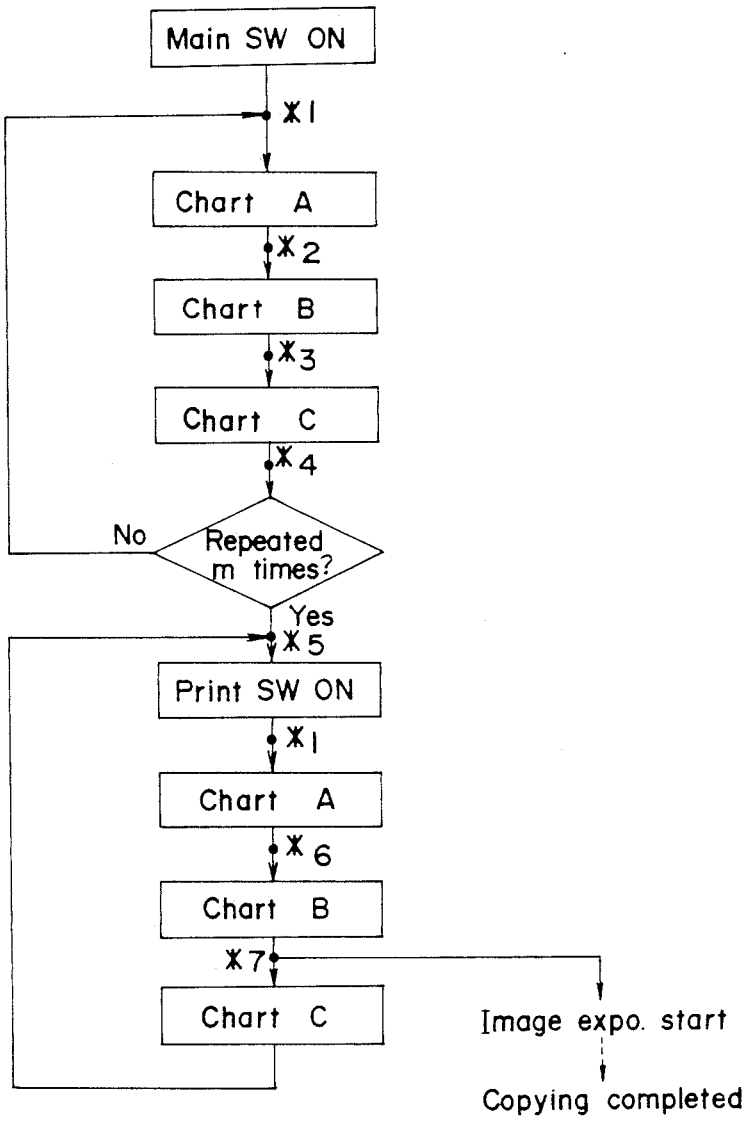
FIGS. 9 through 12 are flow charts explanatory of the functionings of the copying apparatus of FIG. 6.

As shown in FIG. 9, it is generally so arranged that, after turning "ON" of a main switch, the process proceeds in the order of a chart A (FIG. 10), a chart B (FIG. 11) and a chart C (FIG. 12), with such a cycle being repeated m times. The cycle as described above is intended to have the reference equations corrected to suit to the surrounding conditions through effective utilization of warm-up period for heaters of the fixing device (30), etc., and the number of times "m" as referred to above may be set as desired.

It is to be noted here that a process for effecting exposure control may further be inserted between the step for the chart C and the step for the "m" times repetition judgement.

In the manner as described above, the process again proceeds in the order of the charts A, B and C every time the print switch is turned "ON" for successively revising the reference equations described earlier, and for initiating the image exposure so as to effect the copying process in the known manner.

More specifically, the control as described above is effected by a sequence control with the use of a micro-computer.

Figure 10:
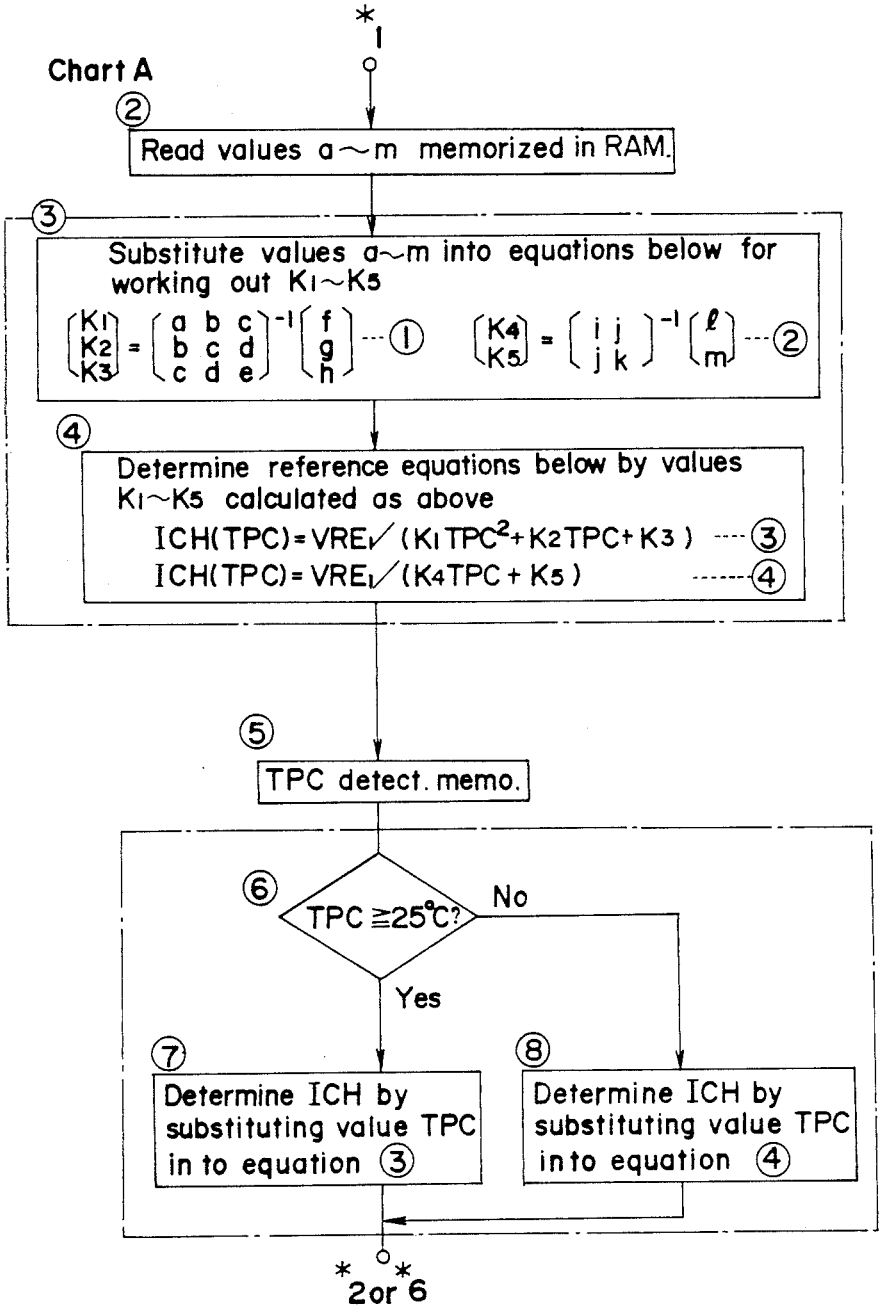

In FIG. 10, in a randon access memory (RAM) of the micro-computer, there are memorized respective values of data a, b, c, d, e, f, g and h for the reference equation determination which has been preliminarily obtained as a result of copying experiments for "n" times under the conditions where the surface temperature (TPC) of the photosensitive layer (1a) of the photoreceptor drum (1) is in the relationship TPC≧25° C., and data i, j, k, l and m for the reference equation determination which has been preliminarily obtained as a result of copying experiments for "n" times under the conditions of TPC<25° C.

It is to be noted here that the above experiments were effected, through variation of the temperature (TPC) of the photoreceptor drum, by obtaining the current (ICH) caused to flow through the charging corona charger and suitable for charging the photosensitive surface (1a) of the drum (1) to the target charge potential (VRE) and more specifically, to 600 V (negative polarity). As a result of the above experiments, "n" sets of data $(TPC_1, ICH_1)$ . . . , and $(TPC_n, ICH_n)$ have been obtained.

More specifically, the values for a, b, c, d, e, f, g, h, i, j, k, l and m are represented by equations as follows.

$$a = \sum_{t=1}^{n} TPC_t^4 \quad (1.3153 \times 10^9)$$

$$b = \sum_{t=1}^{n} TPC_t^3 \quad (3.7375 \times 10^7)$$

$$c = \sum_{t=1}^{n} TPC_t^2 \quad (1.0875 \times 10^6)$$

$$d = \sum_{t=1}^{n} TPC_t \quad (3.2500 \times 10^4)$$

$$e = n \quad (1.0 \times 10^3)$$

$$f = \sum_{t=1}^{n} ICH_t \cdot TPC_t^2 \quad (1.3702 \times 10^6)$$

$$g = \sum_{t=1}^{n} ICH_t \cdot TPC_t \quad (4.1313 \times 10^4)$$

$$h = \sum_{t=1}^{n} ICH_t \quad (1.2825 \times 10^3)$$

$TPC \geqq 25°$ C. for the above

-continued $$i = \sum_{t=1}^{n} TPC_t^2 \qquad (2.7500 \times 10^5)$$

$$j = \sum_{t=1}^{n} TPC_t \qquad (1.5000 \times 10^4)$$

$$k = n \qquad (1.0 \times 10^3)$$

$$l = \sum_{t=1}^{n} ICH_t \cdot TPC_t \qquad (2.0710 \times 10^4)$$

$$m = \sum_{t=1}^{n} ICH_t \qquad (1.3920 \times 10^3)$$

$TPC < 25°$ C. for the above

After the values for a to m as described above have been memorized in the random access memory (RAM), it is so arranged that the data for the temperature (TPC) and for the charger current (ICH) are obtained after turning "ON" of the main switch or prior to each copying process by the turning "ON" of the print switch.

More specifically, after turning "ON" of the main switch, the values for a to m memorized in the random access memory (RAM) are read at a step ②, and values for $K_1$, $K_2$, $K_3$, $K_4$ and $K_5$ are calculated at a step ③ so as to determine the reference equations at a step ④. At a step ⑤, the temperature (TPC) of the photoreceptor is detected and memorized, while at a step ⑥, a judgement is made as to whether or not the photoreceptor temperature (TPC) is higher than 25° C. If "Yes", the value for the photoreceptor temperature (TPC) is substituted into the equation (3) at a step ⑦ for the determination of the charger current (ICH). If the judgement is "No", the value of the photoreceptor temperature (TPC) is substituted into the equation (4) at a step ⑧ for the determination of the charger current (ICH).

Figure 11:
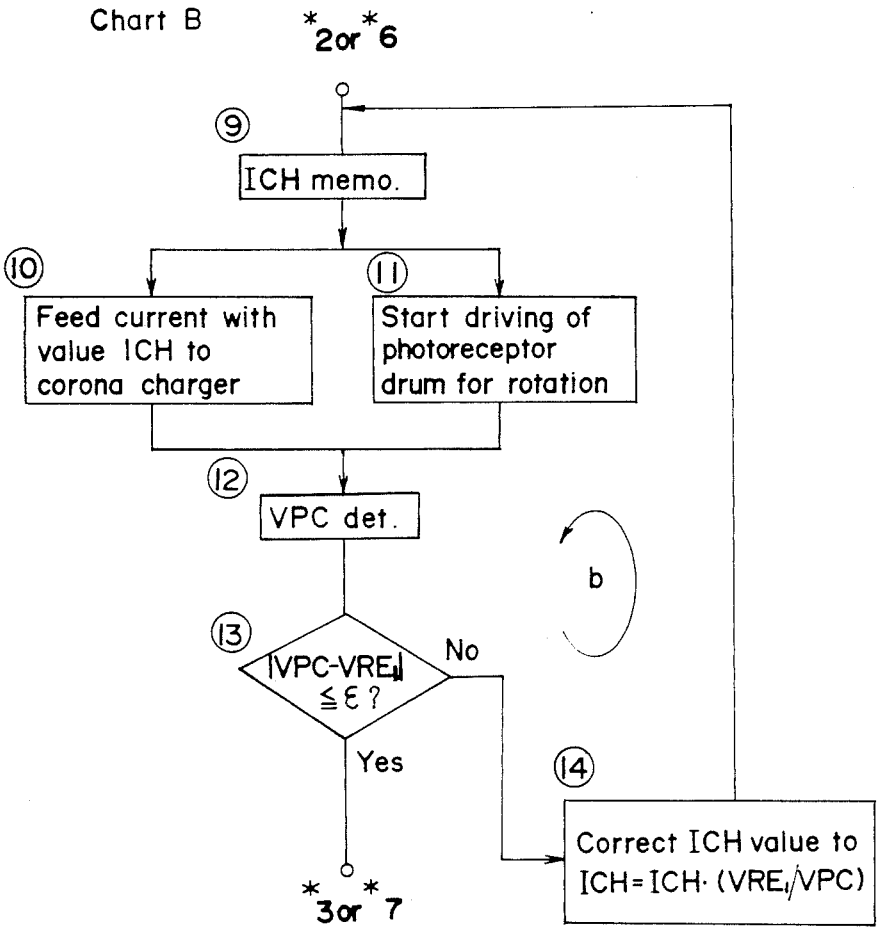

Subsequently, the process is transferred to the chart B in FIG. 11, and at a step ⑨, the charger current (ICH) determined at the step ⑦ or ⑧ is memorized, and at a step ⑩, the current with the value of the charger current (ICH) as described above is caused to flow with respect to the corona charger, while at a step ⑪, the driving of the photoreceptor drum for rotation is started slightly earlier than the above feeding of the current to the corona corona charger. Thereafter, at a step ⑫, the surface potential (VPC) of the photosensitive surface (1*a*) is detected, and at a step ⑬, a judgement is made as to whether or not the relationship is $|VPC-VRE| \leqq \epsilon$, i.e. whether or not a difference between the photoreceptor surface potential (PVC) thus detected and the target charge potential (VRE) is within the allowable range ($\epsilon$).

It should be noted here that, as shown in FIG. 6, the detection of the photoreceptor surface potential (VPC) at the step ⑫ is so timed as to be effected when a point "a" on the photosensitive layer (1*a*) of the photoreceptor drum 1 which has been charged upon flowing of the charger current (ICH) to the corona charger (12), has moved by the distance (l) and reached a position to confront the surface potential detecting element (14).

If the judgement is "Yes" at the step ⑬, the image exposure is initiated for effecting the copying process, while the step is transferred to the chart C. On the contrary, when the judgement is "No" at the step ⑬, the value for the charger current (ICH) is corrected to a value obtained through the multiplication of said value (ICH) by the value for ($VRE_1/VPC$) at a step ⑭, and then the process reverts to the step ⑨ so as to repeat the steps ⑨ through ⑭ so long as the judgement is "No" at the step ⑬. However, if the steps are repeated more that a predetermined number of times, it is considered that an abnormal state such as the stopping of rotation of the photoreceptor drum (1), broken wires in the corona charger (12), etc. may be taking place, and therefore, it is so arranged that, upon the repetition of the steps by more than a predetermined number of times, the state is displayed on a display panel of the copying apparatus housing (not particularly shown) for shutting off the operation of the copying apparatus.

Figure 12:
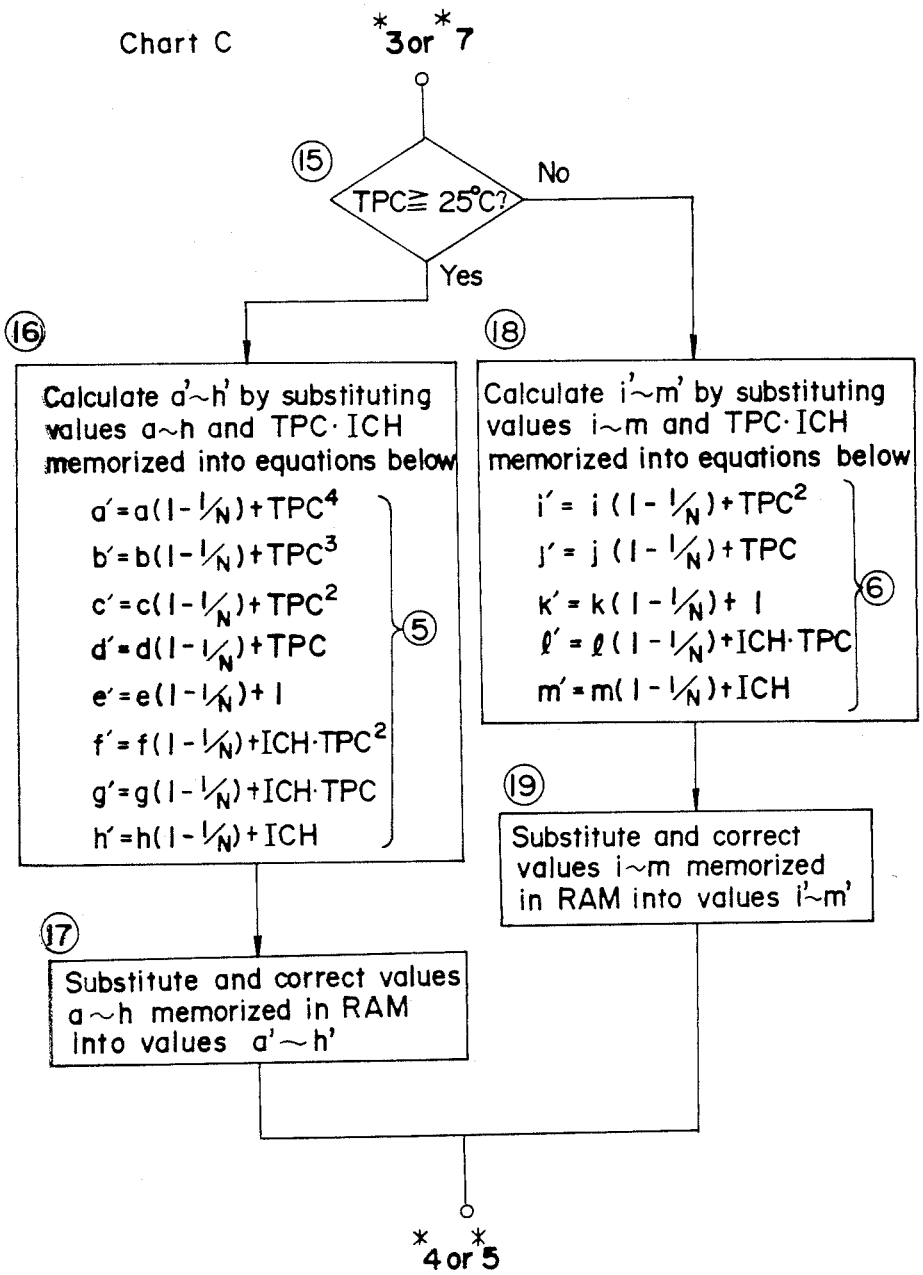

Subsequently, according to the chart C in FIG. 12, fresh values for a', b', c', d', e', f', g', h', i', j', k', l' and m' are calculated so as to successively correct the reference equations described earlier.

More specifically, at a step ⑮, a judgement is made as to whether or not the photoreceptor temperature (TPC) is higher than 25° C., and if the judgement is "Yes", the values for a through h described earlier and the values for (TPC) and (ICH) memorized, are substituted into the equation (5) for the calculation of the values for a' through h' at a step ⑯, and at a step ⑰, the values for a through h memorized in the random access memory (RAM) are substituted and corrected to the values a' through h' for returning to the step ②. Meanwhile, if the judgement is "No", the values for i through m and the memorized values for (TPC) and (ICH) are substituted at a step ⑱ into the equation (6) so as to calculate the values for i' through m', and at a step ⑲, the values for i through m memorized in the random access memory (RAM) are substituted and corrected to the values for i' through m' for returning to the step ②.

In the above chart C, for obtaining the values a' through m', the values a through m are multiplied by $(1-1/N)$ so as to put more weight on the data of the latest (TPC) and (ICH) (set as $N=1000$ in the present embodiment), than on the data prior thereto for reduced contribution to the reference equation determination by increasing the number of multiplications by $(1-1/N)$ as the date become older, and also to prevent the values for a through m infinitely increasing, from overflowing the memory capacity of the random access memory (RAM).

It should be noted here that according to the present embodiment described so far, the surface potential detecting element (14) is not only intended for detection of the charge potential, but also simultaneously utilized for detecting the surface potential of the light projection portion of the photosensitive layer (1*a*) so as to separately adjust the developing bias potential.

In the above case, for increasing the copying speed by reducing the distance (l), the element (14) exclusive for the charge potential detection may be disposed immediately after the corona charger (12).

It should also be noted here that the corona charger described as employed in the foregoing embodiment may be replaced, for example, by a roller charging unit (not shown).

In the case where a corona charger is employed as in the present embodiment, control of charging voltage may be effected by adjusting voltage value to be applied to the charge wire.

Figure 1:
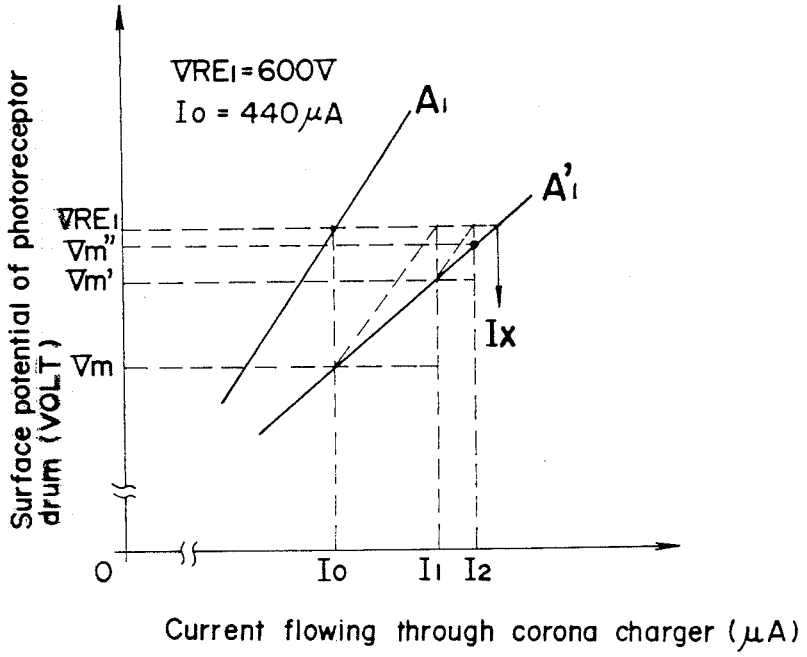
FIGS. 1 through 5 are graphs explanatory of characteristics of photosensitive members or photoreceptors prepared through experiments by the present inventors (already referred to)
Figure 2:
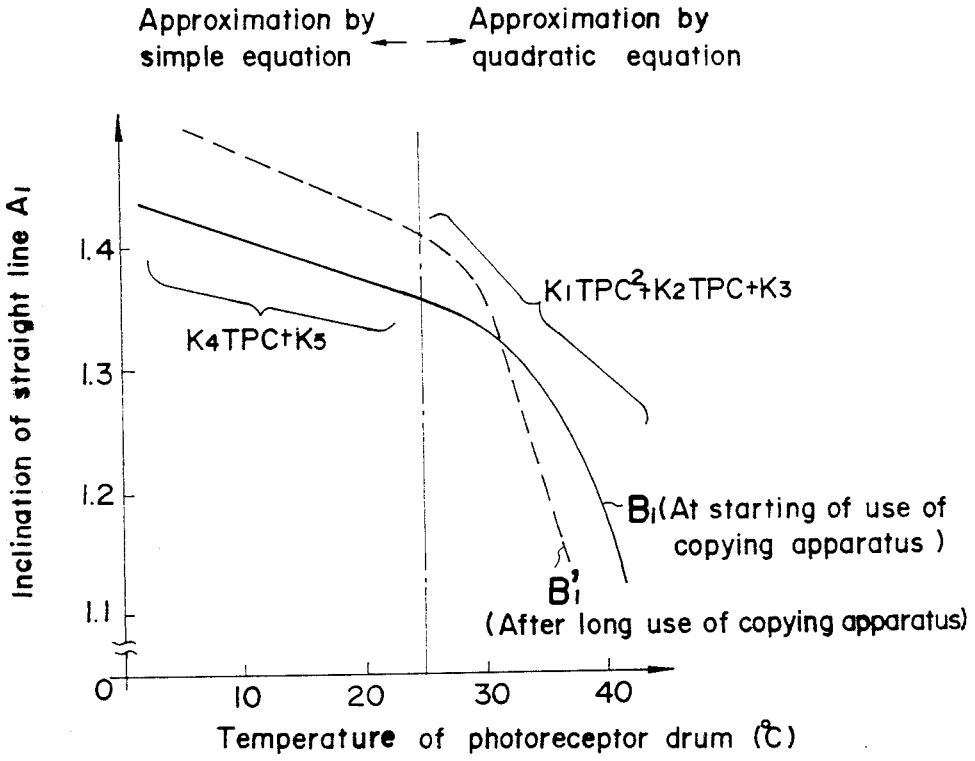

As is seen from the foregoing description, according to the first embodiment of the present invention, since it is so arranged that the characteristics of the photoreceptor are represented by predetermined reference equations for determination of state of functioning of the charging means, while the reference equations are arranged to be successively revised for each copying according to variations of the characteristics, etc. of the photoreceptor during actual use. Therefore, not only the charge potential of the photoreceptor can be maintained quickly at a predetermined value, but the optimum state of functioning of the charging means may be determined through approximation at a high accuracy, and thus, it is not necessary to repeat so many corrections per one copying as in the practice explained with reference to FIG. 1, without any possibility of reduction in the copying speed. Furthermore, since the reference equation itself as described earlier is effectively adaptable to deviations in characteristics of the photoreceptor from lot to lot in the production thereof, or deviations in the installed positions of the photoreceptor, etc. as well as surrounding conditions therefor, it is possible to effect charge potential control suitable for each copying apparatus.

Figure 3:
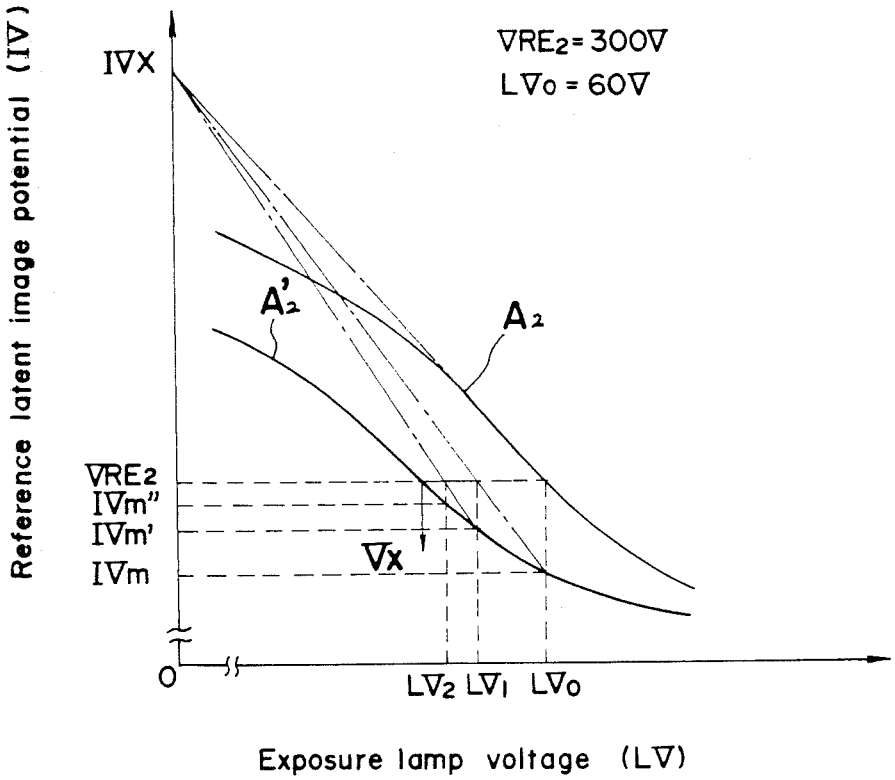
Figure 4:
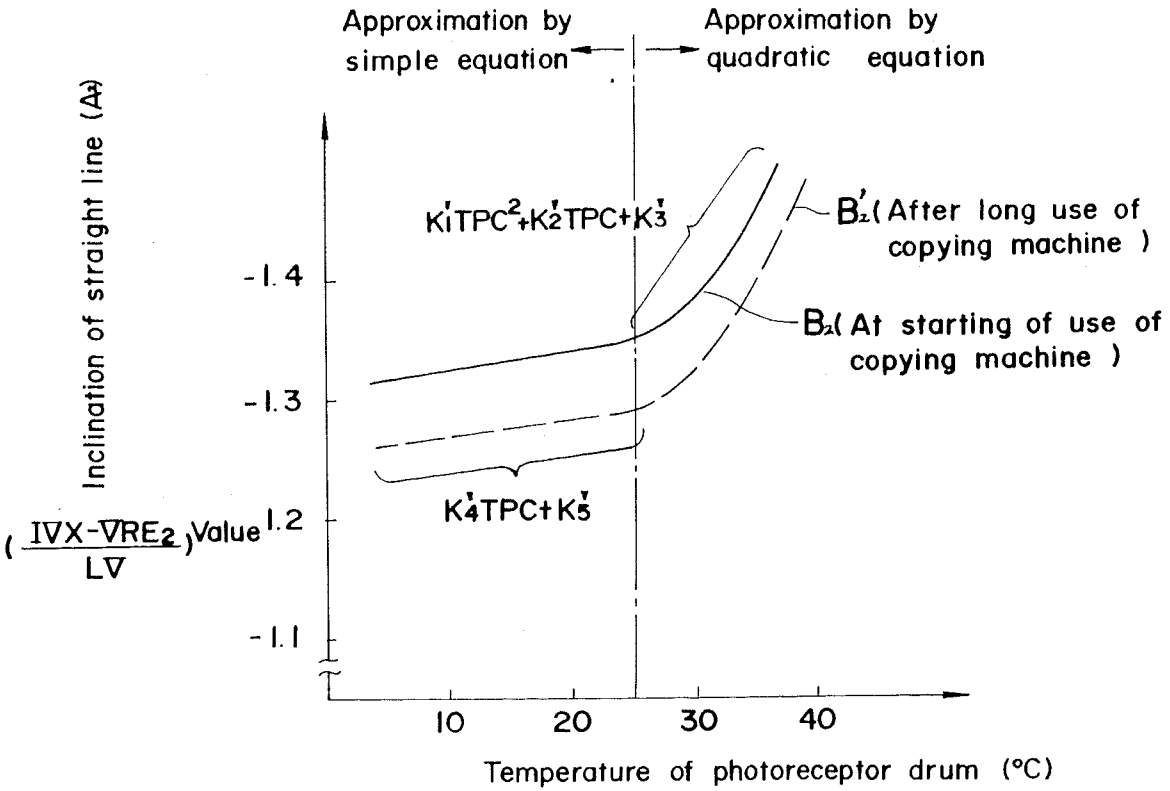
Figure 5:
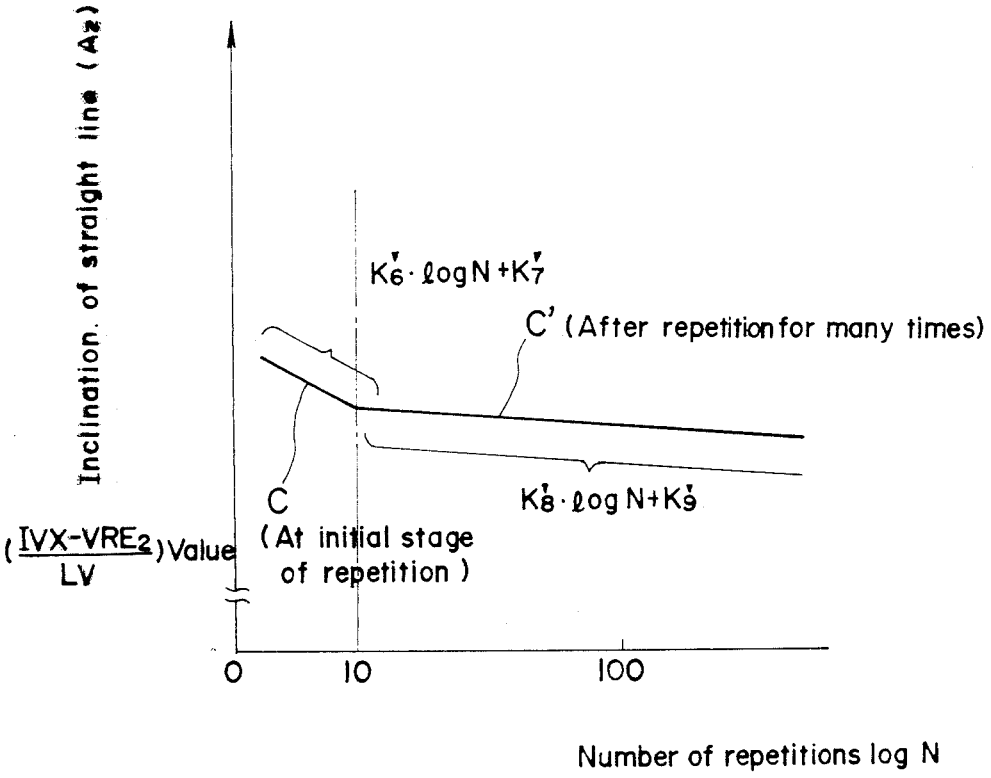

Referring to FIGS. 3 through 5, and also to FIGS. 13 to 21, a second embodiment according to the present invention will be described hereinbelow.

It is to be noted that the essential point of the second embodiment resides in that, the conditions for obtaining optimum image projection light amount which varies depending on surrounding conditions, etc. are represented by predetermined reference equations so as to determine, through approximation, the value of image projection light amount by the image projection optical system, i.e. the value LV as shown in FIG. 3, while the reference equation is arranged to be successively revised so as to determine through approximation and at high accuracy, the value LV in accordance with the variation of the characteristics of the photoreceptor following temperature variation and continuous copying as shown in FIGS. 4 and 5 referred to earlier.

More specifically, according to the second embodiment of the present invention, there is provided a transfer type electrophotographic copying apparatus which includes an electrographic photosensitive member or photoreceptor repeatedly utilized for the formation of electrostatic latent images, a charging means for uniformly charging the surface of said photosensitive member, an image projection optical system for projecting a light image corresponding to an original image onto the surface of said photosensitive member, a reference latent image forming means for forming a reference latent image on the surface of said photosensitive member through said optical system, a condition detecting means for detecting conditions which affect the characteristics of said photosensitive member, a determining means for determining the image projection light amount by said optical system according to the conditions detected by said condition detecting means in a predetermined correlation specifically represented by a reference equation, a potential detecting means for detecting the reference latent image surface potential on the photosensitive member, a correcting means for correcting the image projection light amount by said optical system, based on the surface potential detected by said potential detecting means, so that the surface potential becomes a predetermined value, and a revising means for successively revising said reference equation according to the conditions detected by said condition detecting means and the image projection light amount corrected by said correcting means.

Figure 13:
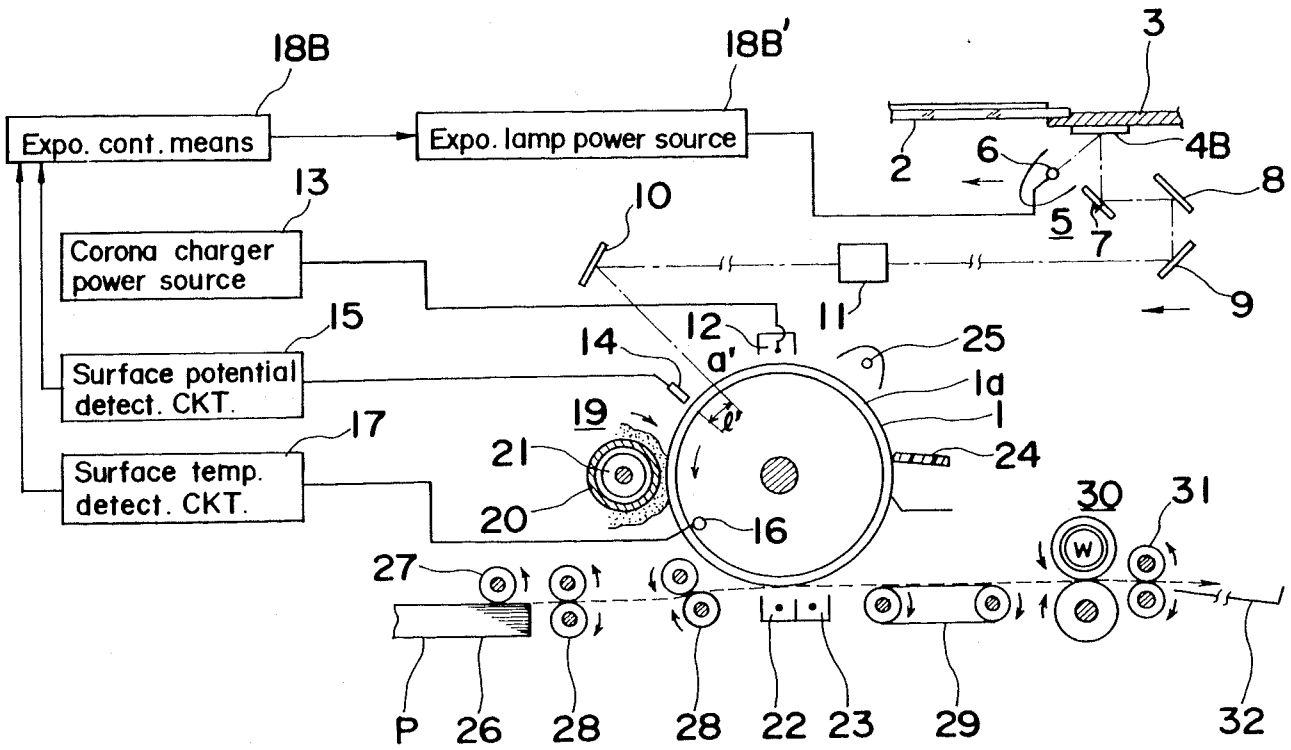
FIG. 13 is a view similar to FIG. 6, which particularly shows a second embodiment thereof.

Referring particularly to FIG. 13, the transfer type electrophotographic copying apparatus according to the second embodiment of the present invention has the constructions generally similar to those in the first embodiment described earlier, except for the points as follows.

More specifically, in the copying apparatus of FIG. 13, the power control means (18) described as employed in the arrangement of FIG. 6 is replaced by an exposure control means (18B) coupled to the light source or exposure lamp (6) through an exposure lamp power source (18B') which is controlled by the exposure control means (18B), while said exposure control means (18B) is arranged to be supplied with outputs from the surface potential detection circuit (15) and the surface temperature detection circuit (17).

Meanwhile, the charge potential adjusting black pattern (4) described as adopted in the arrangement of FIG. 6 is also replaced by a half tone reference latent image forming pattern (4B) with a reflection density of 0.25 corresponding to the reflection density at the background portion of the original image, and provided at the under face of the upper plate (3) at the original image scanning starting side.

Furthermore, to the developing sleeve (20), a developing bias fixed to 300 V (negative polarity) is applied, and therefore, electrostatic latent images at potentials lower than 300 V are not developed.

Since other constructions of the copying apparatus of FIG. 13, characteristics of the photoreceptor (Se.Te alloy photoreceptor), and the principle for determining the reference equation with reference to FIGS. 7 and 8, are generally similar to those in the first embodiment of FIG. 6, detailed description thereof are abbreviated here for brevity, with like parts and like items being represented by like numerals and symbols.

Subsequently, in the second embodiment as described so far, the process for determining the image projection light amount by the image projection optical system (5) (the voltage value to be impressed to the exposure lamp (6)) will be explained with reference to flow charts of FIGS. 14 through 18.

Figure 14:
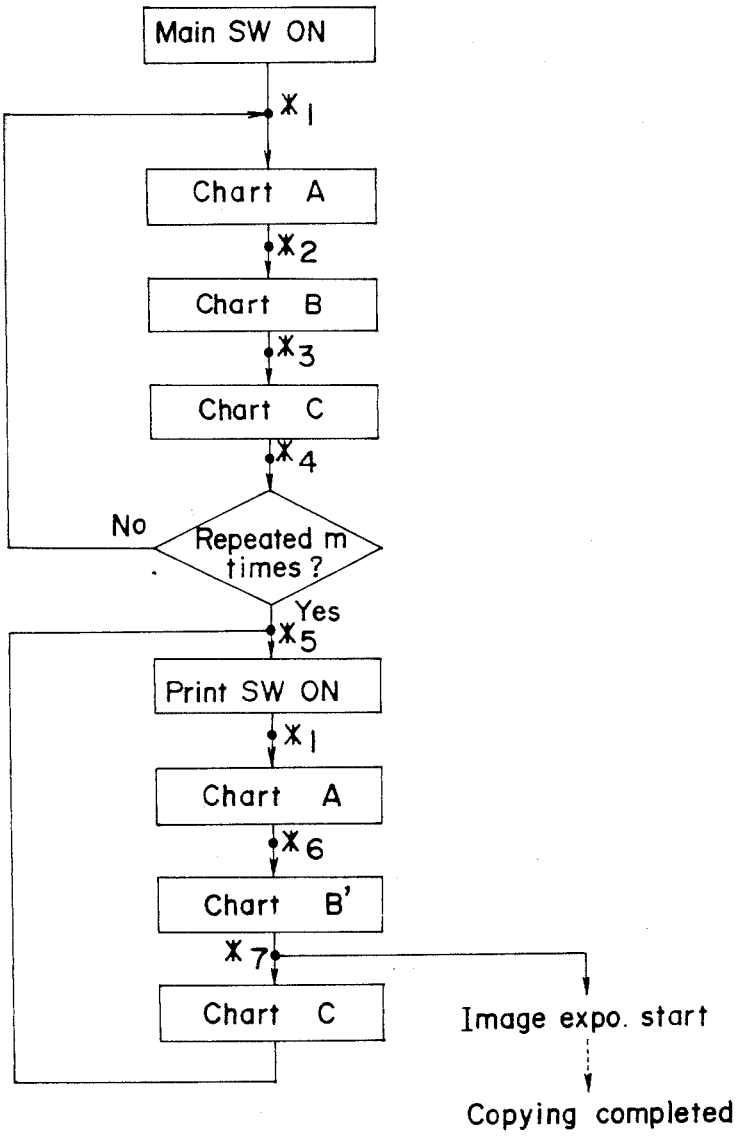
FIGS. 14 through 18 are flow charts explanatory of functionings of the copying apparatus of FIG. 13, FIGS. 9 through 21 are flow charts similar to FIGS. 14 to 18, which particularly show another embodiment.

As shown in FIG. 14, the general arrangement is such that, after turning "ON" of the main switch, the process proceeds in the order of a chart A (FIG. 15), a chart B (FIG. 16) and a chart C (FIG. 17), with such a cycle being repeated "m" times. The cycle as described above is intended to have the reference equations corrected to suit to the surrounding conditions through effective utilization of warm-up period for heaters of the fixing device (30), etc., and the number of times "m" as referred to above may be set as desired in the similar manner as in the first embodiment.

Needless to say, the process for charge control may be inserted immediately before the step of the chart A (after turning ON of the main switch and/or print switch)

In the manner as described above, the process again proceeds in the order of the charts A, B' (FIG. 18) and C every time the print switch is turned "ON" for successively revising the reference equations referred to earlier, and for initiating the image exposure so as to effect the copying process in the known manner.

In the above case, although the chart B' may be the same as the chart B, it is possible that the characteristics of the photoreceptor which are approximated by the reference equations and are preliminarily memorized, are very different from those of the actual photoreceptor in cases where the photoreceptor drum is replaced or the copying apparatus is at rest for a long period, and therefore, the chart B' is specially arranged to be different from the chart B so as to prevent undesirable reduction in the copying speed due to excessively long time required for convergence to the target value. It is to be noted, however, that, the cycles to be repeated "m" times after turning ON of the main switch will invite no particular problems, even if the converging time is prolonged to a certain extent, since they are treated during the warm-up period of the copying apparatus. Therefore, the processing as in the chart B' is not particularly effected.

For a specific practice for reducing the converging time referred to above, in the processing to be effected in the chart B', it is so arranged, as shown in the charts B' (FIG. 18), that the value finally corrected in previous corrections is separately memorized, and after turning ON of the print switch, the weighted average of said memorized value and calculated value of the latest data is employed as a voltage LV to be subsequently applied to the exposure lamp. It is to be noted that $\gamma_1$, which is the contribution coefficient for the main factor, should be selected from a range of 0.1 to 10, and should preferably be approximately one in the present embodiment.

More specifically, the control as described above is effected by a sequence control with the use of a micro-computer.

Figure 15:
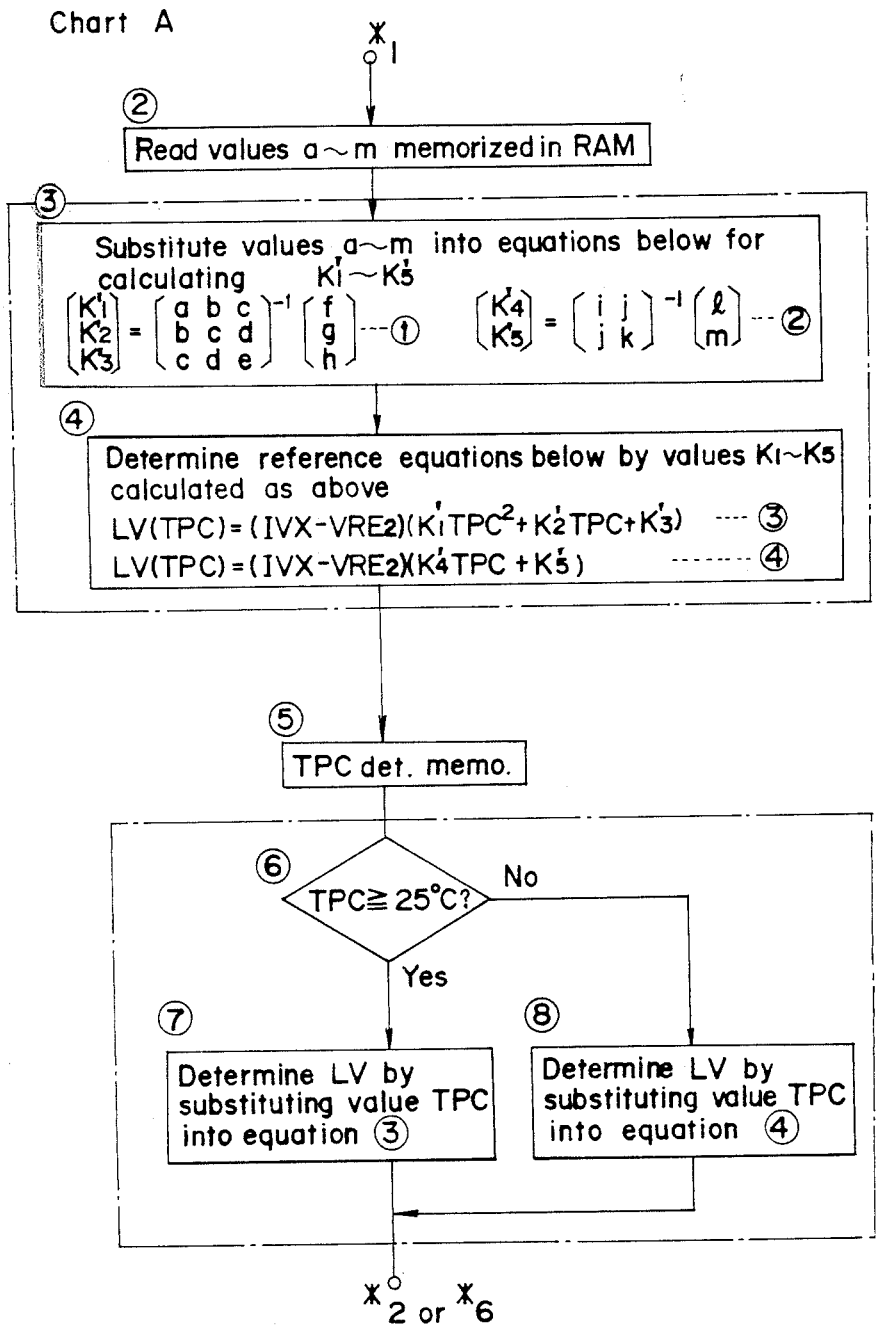

In FIG. 15, in the random access memory (RAM) of the micro-computer, there are memorized respective values of data a, b, c, d, e, f, g and h for a reference equation determination which has been preliminarily obtained as a result of copying experiments for "n" times under the conditions where the surface temperature (TPC) of the photosensitive layer (1*a*) of the photoreceptor drum (1) is in the relationship TPC≧25° C., and data i, j, k, l and m for a reference equation determination which has been preliminarily obtained as a result of copying experiments for "n" times under the conditions of TPC<25° C.

It is to be noted here that the above experiments were carried out, through variation of the temperature (TPC) of the photoreceptor drum, and by obtaining in the above case the exposure lamp voltage LV suitable for decaying the reference latent image surface potential (VRE) to be the final target potential ($VRE_2$) and more specifically, to 300 V (negative polarity). In the above case, the constant IVX was set at 1180, with the charging potential of the photoreceptor drum set at 600 V (negative polarity).

As a result of the above experiments, "n" sets of data ($TPC_1$, $LV_1$) . . . ($TPC_n$, $LV_n$) have been obtained.

More specifically, the values for a, b, c, d, e, f, g, h, i, j, k, l and m are represented by equations as follows.

$$a = \sum_{t=1}^{n} TPC_t^4 \qquad (1.155 \times 10^9)$$

$$b = \sum_{t=1}^{n} TPC_t^3 \qquad (3.411 \times 10^7)$$

$$c = \sum_{t=1}^{n} TPC_t^2 \qquad (1.027 \times 10^6)$$

-continued $$d = \sum_{t=1}^{n} TPC_t \qquad (3.163 \times 10^4)$$

$$e = n \qquad (1.0 \times 10^3)$$

$$f = \sum_{t=1}^{n} \phi_t \cdot TPC_t^2 \qquad (1.759 \times 10^7)$$

$$g = \sum_{t=1}^{n} \phi_t \cdot TPC_t \qquad (5.374 \times 10^5)$$

$$h = \sum_{t=1}^{n} \phi_t \qquad (1.684 \times 10^4)$$

$TPC \geqq 25°$ C. for the above, where $\phi = \dfrac{IVX - VRE}{LV}$ $$i = \sum_{t=1}^{n} TPC_t^2 \qquad (3.4033 \times 10^5)$$

$$j = \sum_{t=1}^{n} TPC_t \qquad (1.767 \times 10^4)$$

$$k = n \qquad (1.0 \times 10^3)$$

$$l = \sum_{t=1}^{n} \phi_t \cdot TPC_t \qquad (2.695 \times 10^5)$$

$$m = \sum_{t=1}^{n} \phi \qquad (1.517 \times 10^4)$$

$TPC < 25°$ C. for the above.

After the values for a to m as described above have been memorized in the random access memory (RAM), it is so arranged that the data for the temperature (TPC) and for the exposure lamp voltage (LV) are obtained after turning "ON" of the main switch prior to each copying process by the turning "ON" of the print switch.

More specifically, after turning "ON" of the main switch, the values for a to m memorized in the random access memory (RAM) are read at the step ② and values for $K_1'$, $K_2'$, $K_3'$, $K_4'$ and $K_5'$ are calculated at the step ③ so as to determine the reference equations at the step ④. At the step ⑤, the temperature (TPC) of the photoreceptor is detected and memorized, while at the step ⑥, a judgement is made as to whether or not the photoreceptor temperature (TPC) is higher than 25° C. If "Yes", the value for the photoreceptor temperature (TPC) is substituted into the equation (3) at the step ⑦ for the determination of the exposure lamp voltage (LV). If "No", the value of the photoreceptor temperature (TPC) is substituted into the equation (4) at the step ⑧ for the determination of the exposure lamp voltage (LV).

Figure 16:
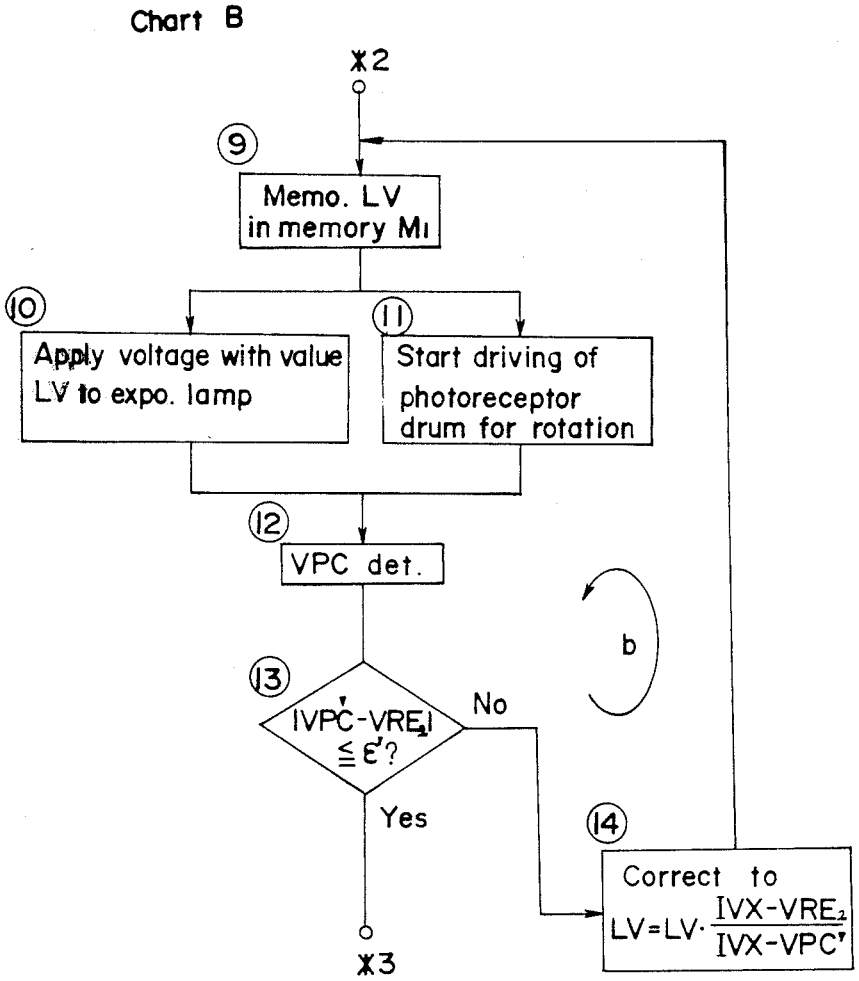

Subsequently, the process is transferred to the chart B in FIG. 16, and at the step ⑨, the exposure lamp voltage (LV) determined at the step ⑧ is memorized in memory ($M_1$), and at the step ⑩, the current with the value of voltage (LV) as described above is caused to flow with respect to the exposure lamp, while at the step ⑪, the driving of the photoreceptor drum for rotation is started earlier than the above feeding of the current. Thereafter, at the step ⑫, the surface potential (VPC') of the photosensitive surface (1*a*) is detected, and at the step ⑬, a judgement is made as to whether or not the relationship is $|VPC' - VRE_2| \leqq \epsilon$, i.e. whether or not a difference between the photoreceptor surface potential (VPC') thus detected and the final target charge potential ($VRE_2$) is within the allowable range ($\epsilon'$).

It should be noted here that as shown in FIG. 13, the detection of the photoreceptor surface potential (VPC') at the step ⑫ is so timed as to be effected when a point "a'" on the photosensitive layer (1a) of the photoreceptor drum (1), where the reference latent image is formed, has moved by the distance (l) and reached a position to confront the surface potential detecting element (14).

Figure 17:
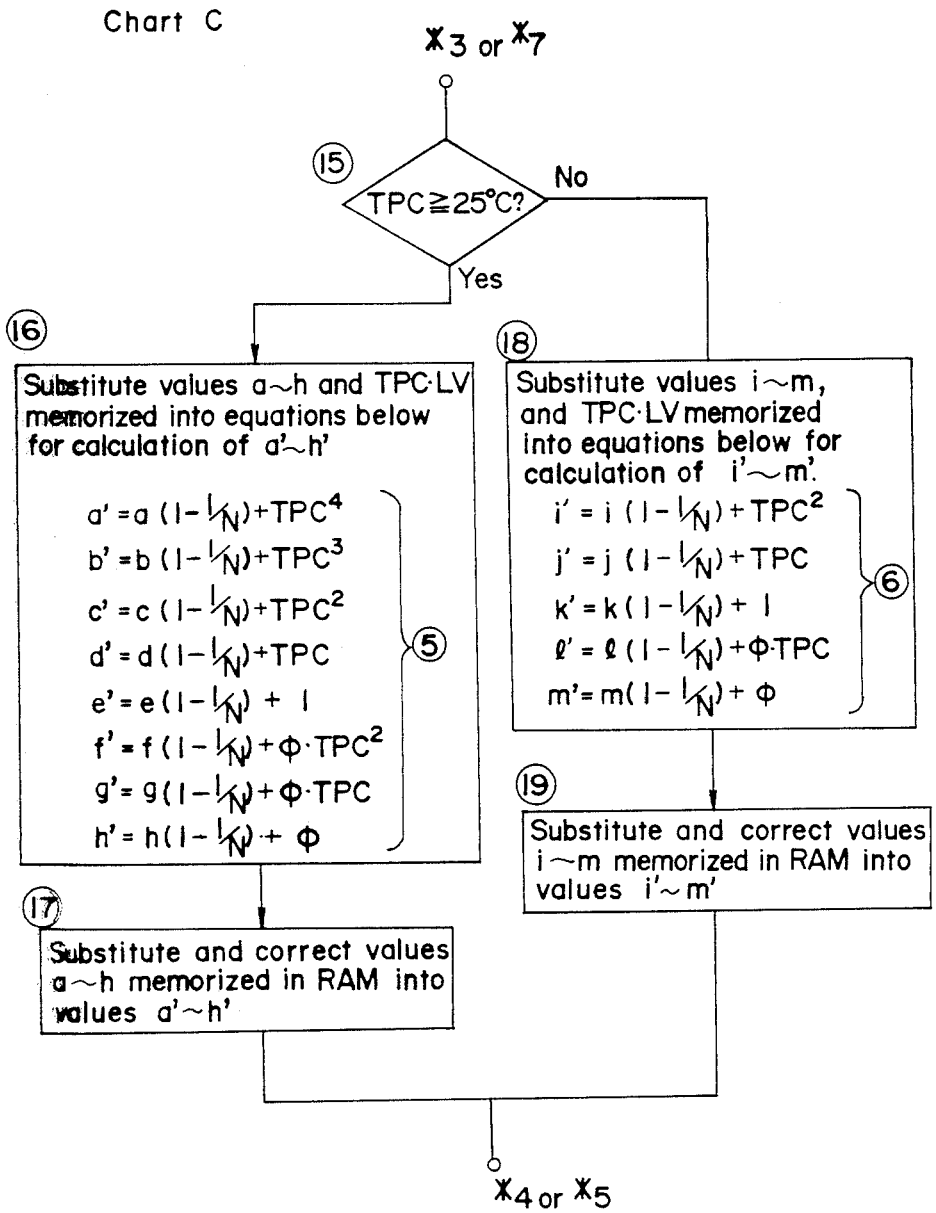

If the judgement is "Yes" at the step ⑬, the image exposure is initiated for effecting the copying process, while the step is transferred to the chart C in FIG. 17. On the contrary, when the judgement is "No" at the step ⑬, the value for the lamp voltage (LV) memorized in the memory ($M_1$) is corrected to a value to be obtained through multiplication of the above value by $IVX-VRE_2/IVX-VPC'$ at a step ⑭, and then, the process reverts to the step ⑨ so as to repeat the steps ⑨ through ⑭ so long as the judgement is "No" at the step ⑬. However, if the steps are repeated more than the predetermined number of times, it is suspected that an abnormal state such as stopping of rotation of the photoreceptor drum (1), a breakage of the exposure lamp, etc. are taking place, and therefore, it is so arranged that, upon repetition of the steps by more than the predetermined number of times, the state is displayed on the display panel of the copying apparatus housing (not particularly shown) for shutting off the operation of the copying apparatus.

Figure 18:
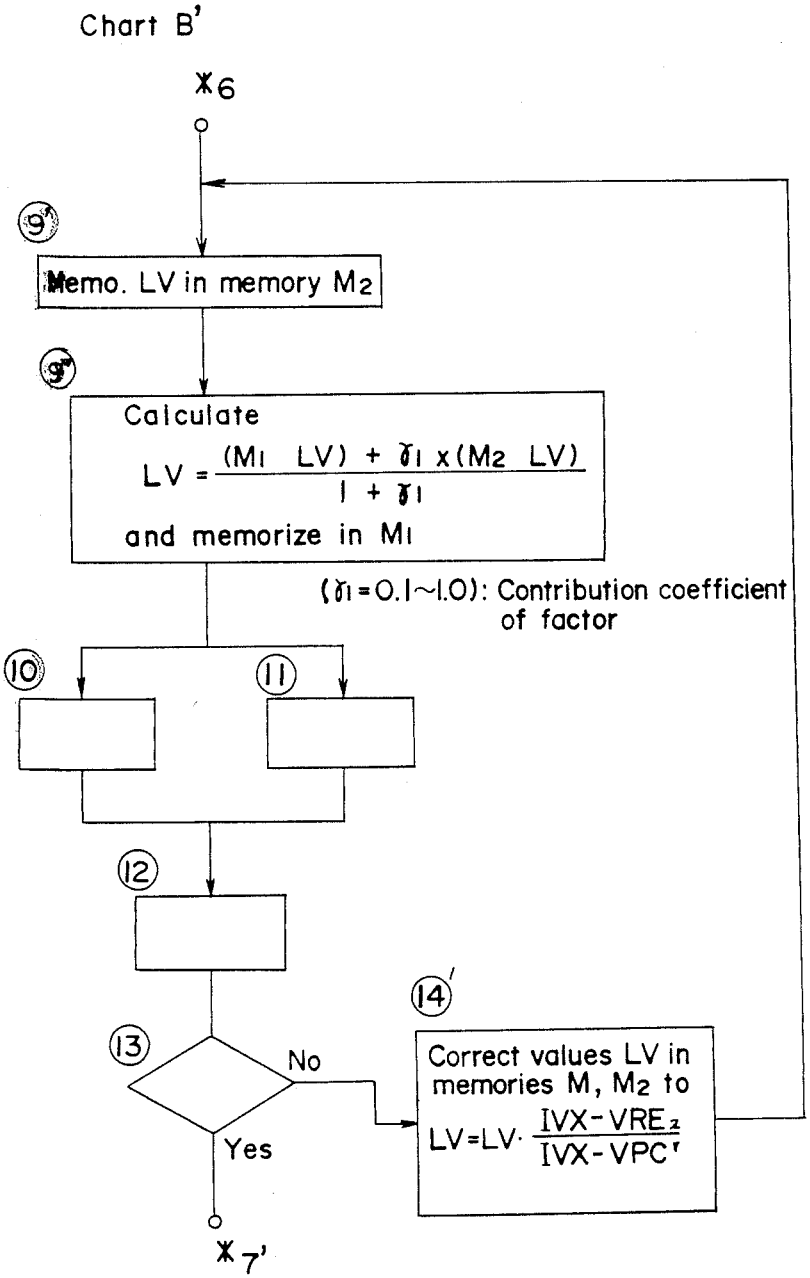

On the other hand, in the case after turning "ON" of the print switch, as shown in FIG. 18, subsequent to the processing in the chart A, the value of the exposure lamp voltage (LV) is memorized in another memory ($M_2$) separate from the memory ($M_1$) described earlier at a step ⑨', and at a step ⑨", a subsequent exposure lamp voltage (LV) is determined by the weighted average thereof with the value previously memorized in the memory $M_1$. In the above case, the values of the lamp voltages (LV) memorized in the memories ($M_1$) and ($M_2$) are corrected to values obtained through multiplication of said values by $$IVX-VRE_2/IVX-VPC'$$

at a step ⑭'. Accordingly, at each passing of the step ⑭', the values for the memories ($M_1$) and ($M_2$) become equal.

Subsequently, according to the chart C in FIG. 17, fresh values for a', b', c', d', e', f', g', h', i', j', k', l' and m' are calculated so as to successively correct the reference equations described earlier.

More specifically, at the step ⑮, a judgement is made as to whether or not the photoreceptor temperature (TPC) is higher than 25° C., and if the judgement is "Yes", the values for a through h described earlier and the values for (TPC) and (LV) memorized are substituted into the equation (5) for the calculation of the values for a' through h' at the step ⑯, and at the step ⑰, the values for a through h memorized in the random access memory (RAM) are substituted and corrected to the values a' through h' for returning to (*4) or (*5) in FIG. 14. Meanwhile, if the judgement is "No", the values for i through m and the memorized values for (TPC) and (LV) are substituted at the step ⑱ into the equation (6) so as to calculate the values for i' through m', and at the step ⑲, the values for i through m memorized in the random access memory (RAM) are substituted and corrected to the values for i' through m' for returning to (*4) or (*5) in FIG. 14.

In the above chart C, for obtaining the values a' through m', the values a through m are multiplied by $(1-1/N)$ so as to put more weight on the data of the latest (TPC) and (LV) (set as $N=1000$ in the present embodiment), than on the data prior thereto for reduced contribution to the reference equation determination by increasing the number of multiplications by $(1-1/N)$ as the date becomes older, and also to prevent the values for a through m infinitely increasing, from overflowing the memory capacity of the random access memory (RAM).

In the foregoing embodiment, although control is effected, with attention directed only to the photoreceptor temperature as the determining factor of the exposure lamp voltage, it may be possible to effect more accurate and quick control, if other factors such as the number of repetition of copying process, rest time of the apparatus, etc. are memorized as data for performing control in which characteristic variations of the photoreceptor with respect to these data are taken into account.

Accordingly, the case where the number of repetition of copying process (N) is adopted besides the photoreceptor temperature (TPC) will be described hereinbelow as another embodiment with reference to FIGS. 19 through 21.

Figure 19:
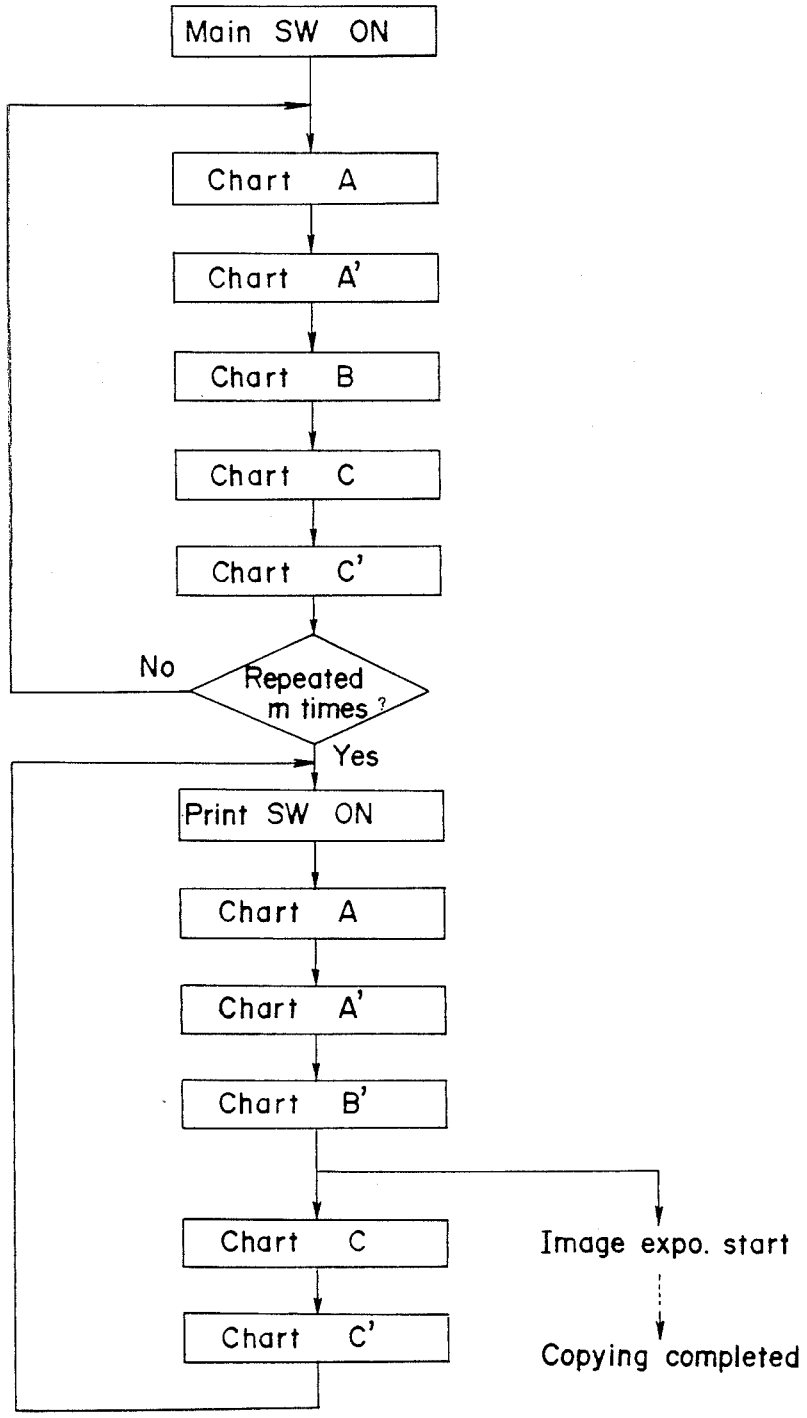
Figure 20:
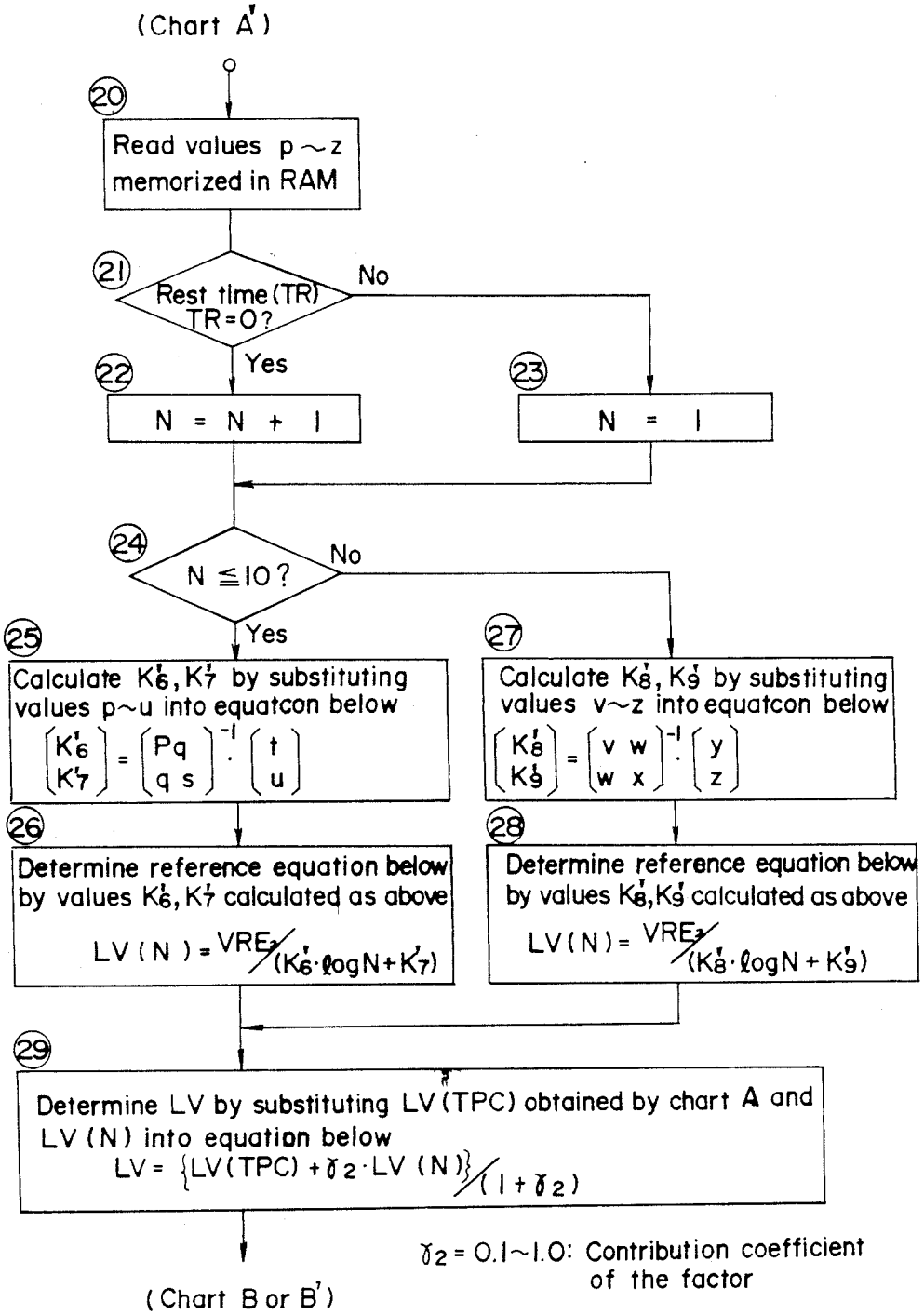
Figure 21:
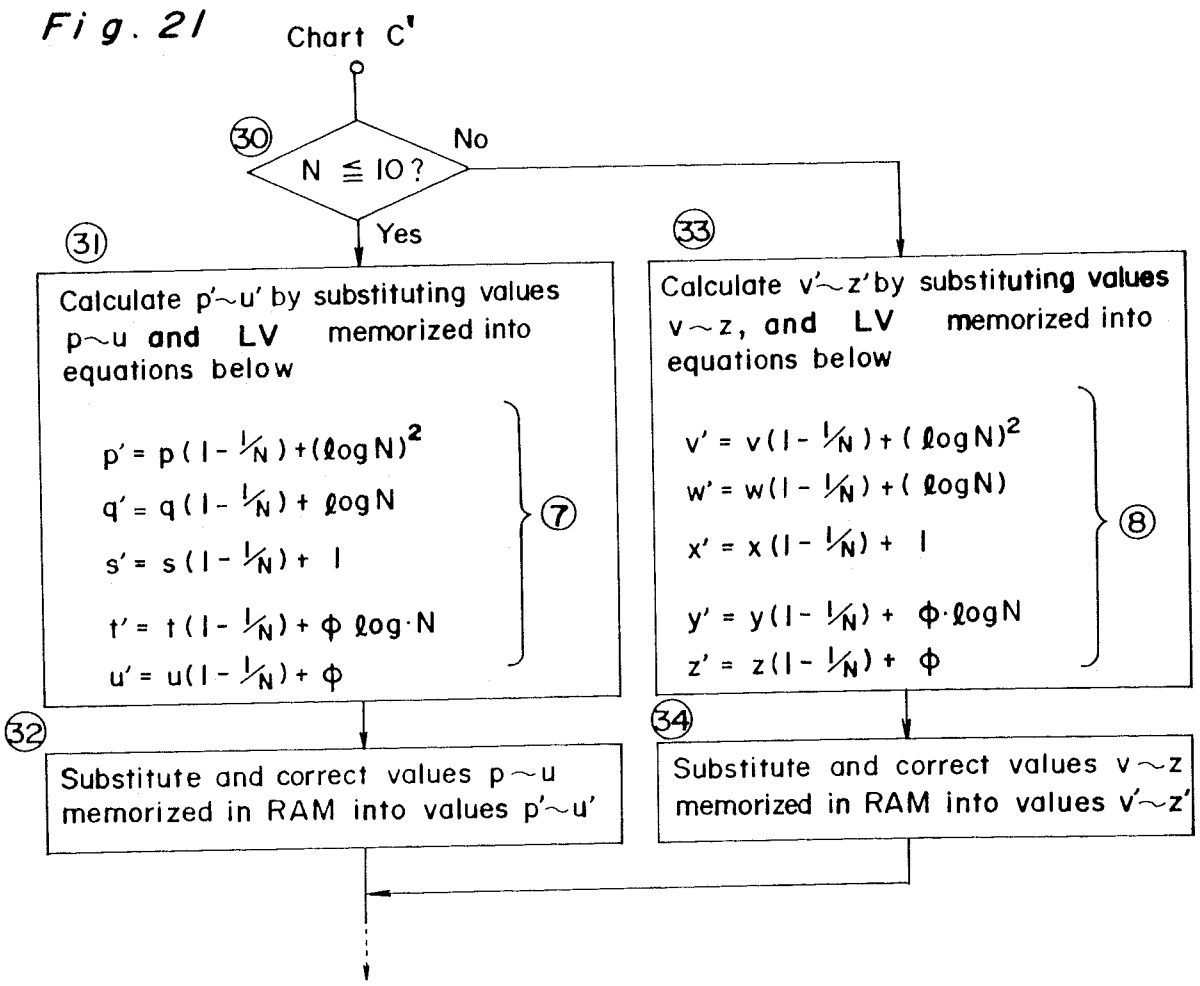

In FIG. 19, there is shown a process for determining the value for voltage with respect to the exposure lamp in the similar manner as in FIG. 14, and the charts A, B, B' and C are given in FIGS. 15, 16, 18 and 17, respectively, while the charts A' and C' are shown in FIGS. 20 and 21.

Fundamentally, in FIG. 19, it is so arranged that the exposure lamp voltage (LV) is determined by the weighted average of the value LV(TPC) derived from the reference equation based on the temperature characteristics of the photoreceptor and the value LV(N) the another reference equation based on the characteristics for the number of repetition of copying process. It is to be noted here that the "weighted average" referred to above means setting up the rate of contribution by each factor with respect to the photoreceptor characteristic variations, and multiplying by a proper coefficient for each factor.

More specifically, in the chart A' (FIG. 20), values for p to z memorized in the random access memory (RAM) are read at a step ⑳, and at a step ㉑, a judgement is made as to whether or not the rest time (TR) is 0. The rest time referred to above means the time between respective copying processes, because, in other words, the step ㉑ is intended to check whether or not the copying is a continuous copying, and the rest time without carrying out a copying process has been checked as the factor causing the photoreceptor characteristic variations. If the step ㉑ is "YES", 1 is added to the number of repetition (N) at the step ㉒. Subsequently, at the step ㉔, a judgement is made as to whether or not the number of repetitions is smaller than 10. If "YES", $K_6'$ and $K_7'$ are calculated at a step ㉕ for the determination of the reference equation at a step ㉖. Meanwhile, if the judgement is "NO", $K_8'$ and $K_9'$ are calculated at a step ㉗ for the determination of the reference equation at a step ㉘. In a step ㉙, the exposure lamp voltage LV(TPC) obtained in the chart A (FIG. 15), and the exposure lamp voltage LV(N) obtained either in the step ㉖ or in the step ㉘ are subjected to the weighted averaging for the determination of the final lamp voltage (LV). It is to be noted that ($\gamma_2$) which is the contribution coefficient of the factor is selected in the range of 0.1 to 10, and should preferably be 1 in this embodiment.

On the other hand, in the chart C' (FIG. 21), a judgement is made as to whether or not the number of repetitions (N) is smaller than 10, and if "YES", the values for p to u and the values of (LV) memorized are substituted into the the equation (7) at a step ㉛ for calculation of the values for P' to u', and at a step ㉜ , the values for p to u memorized in the random access memory (RAM) are substituted and corrected into the values for p' to u'. Meanwhile, if the judgement is "NO", the values of V to Z mentioned earlier and the values of (LV) memorized are substituted into the equation (8) for calculation of v' to z' at a step ㉝ , and thus, at a step ㉞ , the values of v to z memorized in the random access memory (RAM) are substituted and corrected into the values of v' to z'.

It is to be noted here that, in the present invention, for controlling the image projection light amount by the image projection optical system, the system for controlling the voltage to be applied to the exposure lamp described as adapted in the foregoing embodiments may be replaced by other systems, for example, a system for controlling the width of a slit which restricts the exposure width with respect to the electrographic photoreceptor.

As is clear from the foregoing description, according to the second embodiment of the present invention, since it is so arranged that the image projection light amount by the image projection optical system is determined through representation of the photoreceptor characteristics by the predetermined reference equation, while the reference equation is successively corrected at each copying according to variations of the characteristics of the photoreceptor, during actual use, the potential at the background portion of the electrostatic latent image may be quickly maintained at a predetermined value and furthermore, owing to the fact that the optimum image projection light amount by the image projection optical system is determined through approximation at high accuracy, there is no necessity to repeat so many corrections per one copying as in the practice shown in FIG. 3, without giving rise to undesirable reduction in the copying speed. Moreover, since the reference equation itself referred to earlier is adaptable not only for using conditions, surrounding circumstances, etc., but also, effectively for deviations in characteristics from lot to lot in the production of photoreceptors, deviations in the installing position of the image projection optical system, and reduction in light amount due to soiling of the optical system, deterioration of the exposure lamp, etc., it is possible to control the image projection light amount to suit to each copying apparatus.

Figure 22:
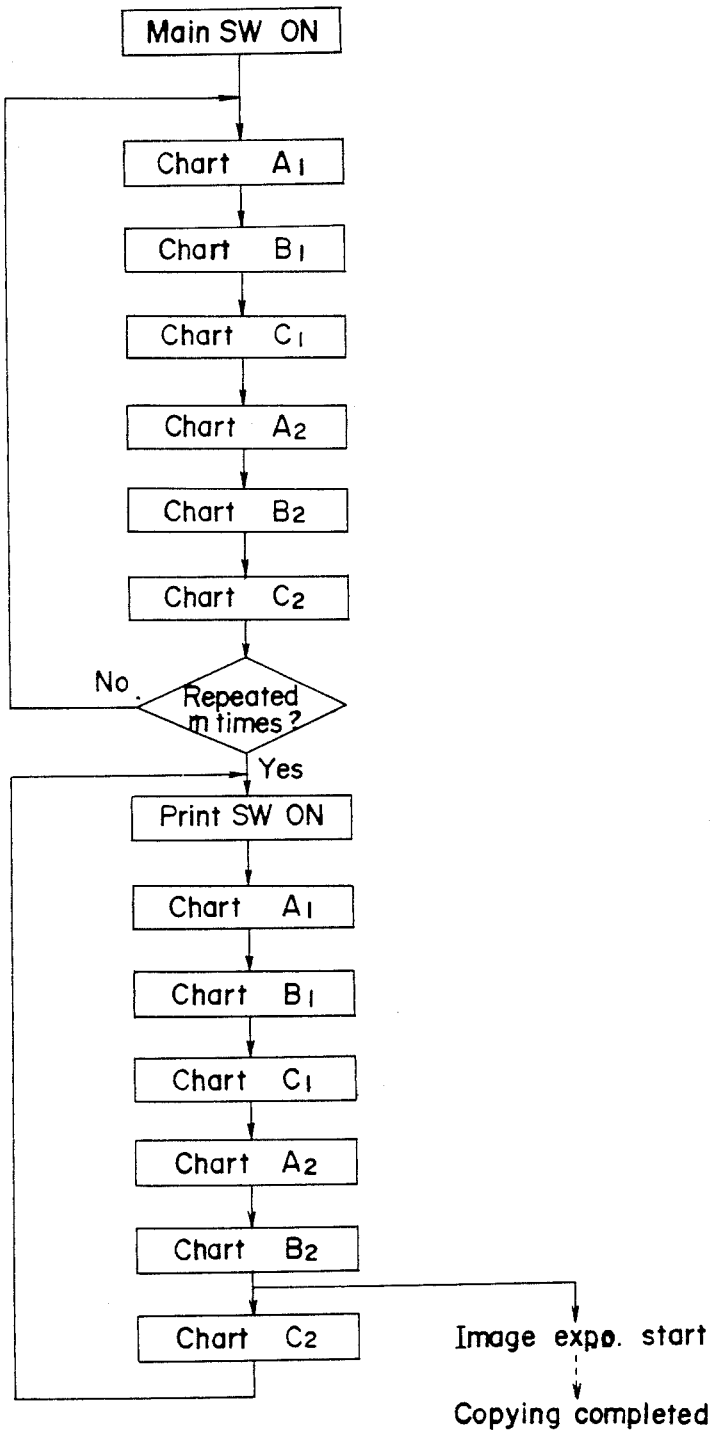
FIGS. 22 through 24 are flow charts similar to FIGS. 19 to 21, which particularly relate to a third embodiment of the present invention.
Figure 23:
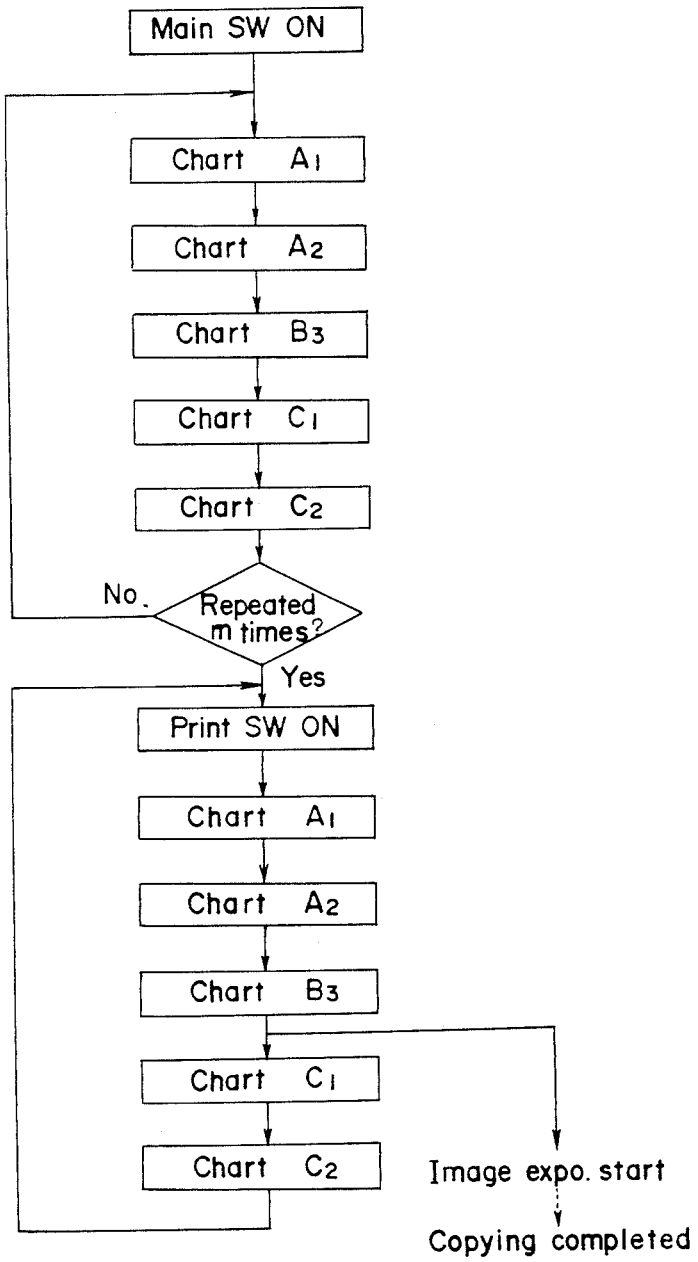
Figure 24:
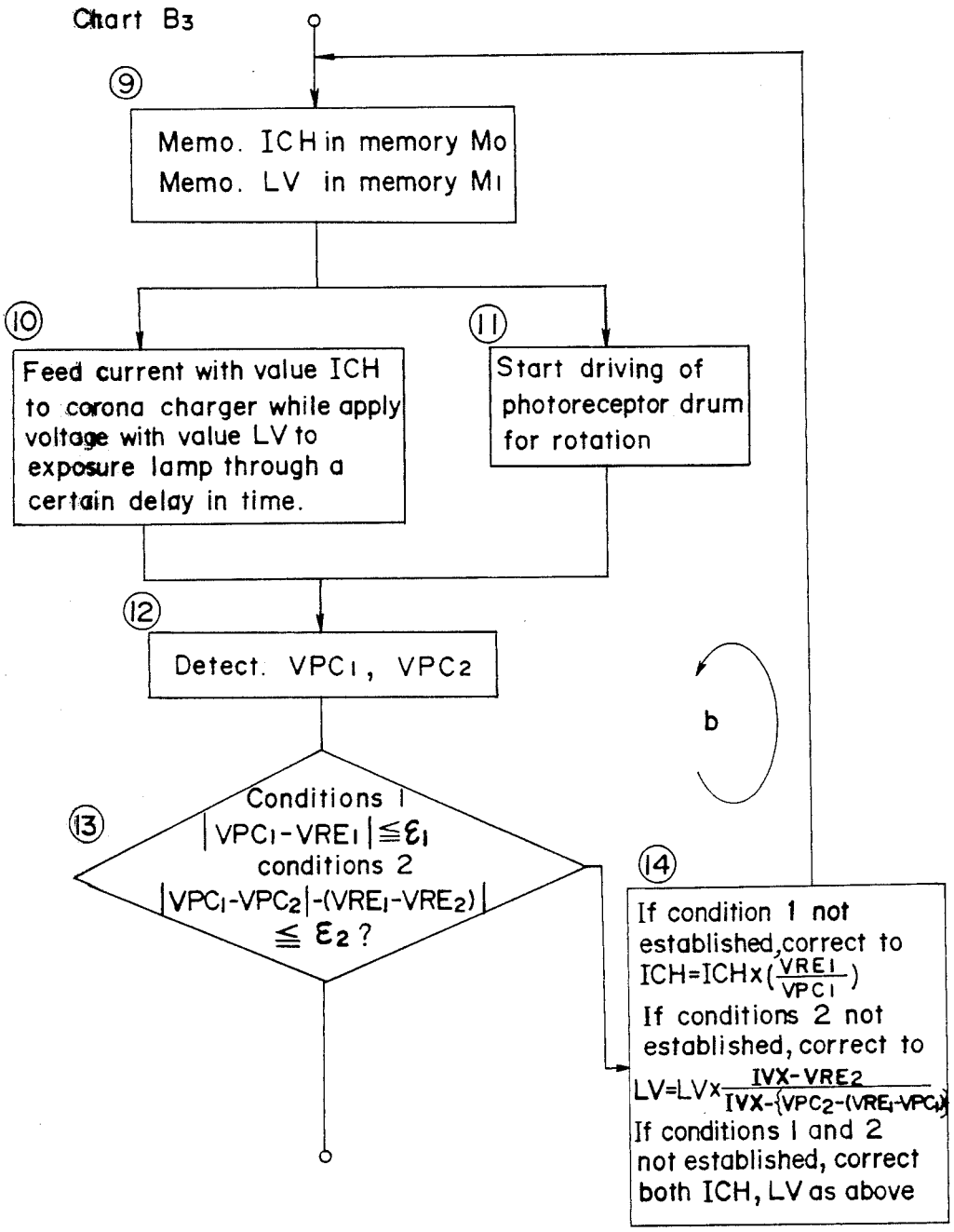

Referring further to FIGS. 22 to 24, there is shown a third embodiment according to the present invention, in which the reference equation is corrected by the procedures as illustrated in charts of FIGS. 22 and 23.

In the third embodiment of FIGS. 22 to 24, the arrangement of the copying apparatus of FIG. 6 or 13 must be so modified that a charge potential adjusting black pattern and a reference latent image forming pattern are disposed in a parallel relationship at the underface of the upper plate, with two surface potential detecting elements being simultaneously provided, although these are not particularly shown.

In FIG. 22, the charts $A_1$ to $C_1$ are equivalent to the charts A to C of the first embodiment (FIG. 6), while the charts $A_2$ to $C_2$ are equivalent to the chart A to C of the second embodiment (FIG. 14).

It is to be noted here that in the procedures of FIG. 22, the expediting the processing as in the chart B of the second embodiment (i.e. expediting of the processing in which the replacement of photoreceptor is taken into account) is not effected, although other processings are generally similar to those in the first and second embodiments, with detailed description thereof being abbreviated for brevity.

Meanwhile, in the procedures of FIG. 23, a chart $B_3$ as shown in FIG. 24 is further included, in which the charger current (ICH) is memorized in the memory ($M_0$), while the exposure lamp voltage (LV) is memorized in the memory $M_1$ at the step ⑨, and at the step ⑩ , a current with the value (ICH) is caused to flow with respect to the corona charger, while a voltage with the value (LV) is impressed to the exposure lamp through a certain extent of time delay, which is equivalent to the time delay sufficient to allow the point "a" in FIG. 6 for the first embodiment to reach the exposure portion. At the step ⑪ , driving of the photoreceptor drum is started, and thereafter, at the step ⑫ , a potential ($VPC_1$) (which is the potential of the latent image corresponding to the black pattern and equivalent to (VPC) in the first embodiment) and a potential ($VPC_2$) (which is the potential of the latent image corresponding to the reference pattern and equivalent to (VPC') of this embodiment), are detected. Subsequently, at the step ⑬ , a judgement is made as to whether or not the conditions 1 ($|VPC_1-VRE_1| \leqq \epsilon_1$?) and conditions 2($|(VPC_1-VPC_2)-(VRE_1-VRE_2)| \leqq \epsilon_2$?) are established (($VRE_1$) is the target potential of ($VPC_1$) and equivalent to ($VRE_1$) of the first embodiment, while ($VRE_2$) is the target potential of ($VPC_2$) and equivalent to ($VRE_2$) of the second embodiment). If the conditions 1 are not met at the step ⑬ , a correction is made to $ICH=ICH\times(VRE_1/VPC_1)$, while if the conditions 2 are not established, a correction is made to $$LV = LV \times \frac{IVXi - VRE_2}{IVX - \{VPC_2 + (VRE_1 - VPC_1)\}}.$$

It is to be noted here that, in the case where ($VPC_1$) itself is not of a proper value, a desired value of ($VPC_2$) is not achieved, even if a proper current is caused to flow through the exposure lamp. Therefore, so far as ($VPC_1$) itself does not become a proper value, pertinent control of (LV) can not be effected by the chart of FIG. 22. Meanwhile, in the manner as described above, if control (correction) is effected on the assumption that ($VPC_1$) has become the proper value anyhow, the control (correction) of LV may be effected properly regardless of the value of ($VPC_1$).

In the above case, if the conditions 1 and 2 are not established, both (ICH) and (LV) are to be corrected as described above.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A transfer type electrophotographic copying apparatus which comprises an electrographic photosensitive member which is repeatedly utilized for formation of electrostatic latent images thereon, an image forming means for forming an electrostatic latent image on a surface of said photosensitive member, a condition detecting means for detecting conditions affecting operating characteristics of said photosensitive member, a determining means including means for determining a state of operation of said image forming means according to said conditions detected by said detecting means by determining if said conditions are in a predetermined relationship which is specifically represented by a predetermined reference equation, a correcting means for correcting said state of operation of said image forming means so that a potential of said electrostatic latent image formed on said surface of the photosensitive member is made substantially constant, and a means for successively revising said reference equation based both on said conditions detected by said detecting means and said state of operation which has been corrected by said correcting means, said revising means revising said reference equation through substitution of the coefficients of the reference equation by newly calculated ones, by calculating the coefficients of the reference equation based on both the condition detected by said detecting means and the state of operation corrected by said correcting means.

2. A transfer type electrophotographic copying apparatus as claimed in claim 1, wherein said reference equation includes said conditions affecting said characteristics of said photosensitive member as variables and wherein said determining means derives said state of operation of said image forming means by substituting said detected conditions into said reference equation.

3. A transfer type electrophotographic copying apparatus which comprises an electrographic photosensitive member which repeatedly utilized for formation of electrostatic latent images thereon, a charging means for uniformly charging a surface of said photosensitive member prior to image exposure during formation of a electrostatic latent image, a condition detecting means for detecting conditions affecting operating characteristics of said photosensitive member, a determining means including means for determining a state of operation of said charging means according to said conditions detected by said detecting means by determining if said conditions are in a predetermined relationship which is specifically represented by predetermined reference equation, a potential detecting means for detecting a surface potential of said photosensitive member after having been charged by said charging means, a correcting means for correcting said state of operation of said charging means, based on said surface potential detected by said potential detecting means, so that said surface potential of said photosensitive member becomes a predetermined value, and a revising means for successively revising said reference equation based on said conditions detected by said condition detecting means and said state of operation which has been corrected by said correcting means.

4. A transfer type electrophotographic copying apparatus which comprises an electrographic photosensitive member which is repeatedly utilized for formation of electrostatic latent images, a charging means for uniformly charging a surface of said photosensitive member, an image projection optical system for projecting a light image corresponding to an original image onto said surface of said photosensitive member, a reference latent image forming means for forming a reference latent image on said surface of said photosensitive member through said optical system, a condition detecting means for detecting conditions affecting operating characteristics of said photosensitive member, a determining means including means for determining an amount of image light projected by said optical system according to said conditions detected by said condition detecting means, said conditions being in a predetermined relationship which is specifically represented by a predetermined reference equation, a potential detecting means for detecting a reference latent image surface potential on the photosensitive member, a correcting means for correcting said amount of image light projected by said optical system based on a surface potential detected by said potential detecting means so that said surface potential becomes a predetermined value, and a revising means for successively revising said reference equation according to said conditions detected by said condition detecting means and said amount of image light which has been projected by said optical system and which has been corrected by said correcting means.

* * * * *